US011038296B2

(12) United States Patent
Shimada et al.

(10) Patent No.: US 11,038,296 B2
(45) **Date of Patent: *Jun. 15, 2021**

(54) ELECTRIC CONNECTOR WITH ROTATABLY MOUNTED COVER MEMBER

(71) Applicant: I-PEX Inc., Kyoto (JP)

(72) Inventors: Yoshinobu Shimada, Ogori (JP); Masataka Muro, Ogori (JP); Hirotake Kaneko, Ogori (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/794,249

(22) Filed: Feb. 19, 2020

(65) Prior Publication Data

US 2020/0266564 A1 Aug. 20, 2020

(30) Foreign Application Priority Data

Feb. 20, 2019 (JP) ..... JP2019-028545

(51) Int. Cl.
*H01R 12/79* (2011.01)
*H01R 13/502* (2006.01)
(Continued)

(52) U.S. Cl.
CPC ..... *H01R 12/79* (2013.01); *H01R 12/775* (2013.01); *H01R 13/502* (2013.01); *H01R 13/62* (2013.01)

(58) Field of Classification Search
CPC ..... H01R 12/88; H01R 12/79; H01R 12/772; H01R 12/774; H01R 13/193; H01R 12/57;
(Continued)

(56) References Cited

U.S. PATENT DOCUMENTS 7,179,107 B2 2/2007 Shen et al.
7,361,042 B2 * 4/2008 Hashimoto ..... H01R 12/88 439/260
(Continued)

FOREIGN PATENT DOCUMENTS

CN 1453904 11/2003
CN 101242043 8/2008
(Continued)

OTHER PUBLICATIONS

Soei Patent and Law Firm, Statement of Related Matters, dated Apr. 9, 2020.

*Primary Examiner* — Edwin A. Leon
*Assistant Examiner* — Matthew T Dzierzynski
(74) *Attorney, Agent, or Firm* — Sofi Patent & Law Firm

(57) ABSTRACT

The electrical connector includes a main body comprising an insertion opening into which a connection target is inserted and an accommodation space to accommodate the connection target inserted into the insertion opening, a conductive contact held in the main body so as to be connected to the connection target in the accommodation space, and a cover member rotatably mounted on the main body to be rotatable around a rotation axis passing through the main body. An insertion opening which extends along the rotation shaft and into which the connection target is inserted is provided in the housing. The cover member includes a release operation portion configured to receive an external force to rotate the cover member around the rotation axis, and a restricting member to switch, in response to the rotation of the cover member, between a first state in which removal of the connection target from the accommodation space is restricted and a second state in which the connection target is released. The insertion opening is spaced apart from, and opens away from, the rotation axis. A distance between the
(Continued)

release operation portion and the insertion opening is less than a distance between the rotation axis and the insertion opening.

21 Claims, 16 Drawing Sheets

(51) Int. Cl.
*H01R 13/62* (2006.01)
*H01R 12/77* (2011.01)

(58) Field of Classification Search
CPC ..... H01R 12/592; H01R 12/616; H01R 12/7011; H01R 12/771; H01R 12/775; H01R 12/78; H01R 12/89; H01R 13/24; H01R 13/62; H01R 13/6273; H01R 13/633; H01R 13/6594; H01R 4/5066
See application file for complete search history.

(56) References Cited

U.S. PATENT DOCUMENTS

| | | | | |
|---|---|---|---|---|
| 7,361,048 | B2 * | 4/2008 | Shimada | H01R 12/79 439/492 |
| 7,524,204 | B2 * | 4/2009 | Shimada | H01R 12/79 439/260 |
| 7,727,006 | B1 | 6/2010 | Huang | |
| 8,267,717 | B2 * | 9/2012 | Ishishita | H01R 12/88 439/495 |
| 8,608,509 | B2 * | 12/2013 | Shimada | H01R 12/774 439/607.01 |
| 8,628,343 | B2 * | 1/2014 | Sasaki | H01R 12/88 439/260 |
| 8,641,439 | B2 * | 2/2014 | Tateishi | H01R 12/88 439/260 |
| 8,678,844 | B2 * | 3/2014 | Yoshisuji | H01R 12/592 439/350 |
| 8,708,725 | B2 * | 4/2014 | Shimada | H01R 13/641 439/260 |
| 8,920,183 | B2 * | 12/2014 | Shimada | H01R 12/88 439/260 |
| 8,979,570 | B2 * | 3/2015 | Yokoo | H01R 12/79 439/372 |
| 9,054,451 | B2 * | 6/2015 | Tateishi | H01R 12/774 |
| 9,070,993 | B2 * | 6/2015 | Honda | H01R 13/193 |
| 9,306,321 | B2 * | 4/2016 | Shimada | H01R 12/88 |
| 9,455,513 | B2 * | 9/2016 | Yokoo | H01R 12/88 |
| 9,525,226 | B2 * | 12/2016 | Tamaki | H01R 12/721 |
| 9,655,241 | B2 * | 5/2017 | Ishida | H05K 1/113 |
| 9,793,629 | B2 * | 10/2017 | Tateishi | H01R 13/6273 |
| 10,069,229 | B2 * | 9/2018 | Muro | H01R 12/774 |
| 10,181,661 | B2 * | 1/2019 | Manba | H01R 12/88 |
| 10,305,209 | B2 * | 5/2019 | Ishishita | H01R 12/774 |
| 10,418,733 | B2 * | 9/2019 | Ishimaru | H01R 12/79 |
| 10,559,928 | B2 * | 2/2020 | Muro | H01R 13/6471 |
| 10,566,721 | B2 * | 2/2020 | Nakajima | H01R 12/79 |
| 10,804,652 | B2 * | 10/2020 | Muro | H01R 13/405 |
| 2004/0248447 | A1 * | 12/2004 | Aoki | H01R 12/771 439/260 |
| 2006/0121776 | A1 * | 6/2006 | Kao | H01R 12/79 439/495 |
| 2006/0292911 | A1 * | 12/2006 | Ning | H01R 12/79 439/260 |
| 2010/0159728 | A1 | 6/2010 | Wang et al. | |
| 2011/0104936 | A1 | 5/2011 | Ozeki | |
| 2011/0300759 | A1 | 12/2011 | Ngo | |
| 2012/0077366 | A1 | 3/2012 | Tsunemura | |
| 2012/0142222 | A1 | 6/2012 | Won et al. | |
| 2012/0289093 | A1 * | 11/2012 | Ogura | H01R 12/88 439/629 |
| 2013/0137284 | A1 | 5/2013 | Shindo et al. | |
| 2015/0171536 | A1 * | 6/2015 | Kameda | H01R 12/78 439/329 |
| 2017/0133774 | A1 | 5/2017 | Tateishi | |
| 2017/0331206 | A1 | 11/2017 | Manba | |
| 2018/0166816 | A1 | 6/2018 | Takemoto | |
| 2019/0305454 | A1 * | 10/2019 | Shimada | H01R 12/721 |

FOREIGN PATENT DOCUMENTS

| | | |
|---|---|---|
| CN | 101764314 | 6/2010 |
| CN | 102255186 | 11/2011 |
| CN | 103138110 | 6/2013 |
| CN | 203150821 | 8/2013 |
| CN | 203553406 | 4/2014 |
| CN | 205828727 | 12/2016 |
| CN | 106684599 | 5/2017 |
| CN | 107087437 | 8/2017 |
| CN | 107210551 | 9/2017 |
| CN | 108232505 | 6/2018 |
| CN | 208256948 | 12/2018 |
| JP | 2003-317838 | 11/2003 |
| JP | 2005-196997 | 7/2005 |
| JP | 3118913 | 2/2006 |
| JP | 2008-192574 | 8/2008 |
| JP | 2010-267427 | 11/2010 |
| JP | 2014-011032 | 1/2014 |
| TW | M288981 | 3/2006 |
| TW | M430716 | 6/2012 |

* cited by examiner

ELECTRIC CONNECTOR WITH ROTATABLY MOUNTED COVER MEMBER

CROSS-REFERENCE TO RELATED APPLICATION

This application is based upon and claims the benefit of priority from Japanese Patent Application No. 2019-028545, filed on Feb. 20, 2019, the entire contents of which are incorporated herein by reference.

BACKGROUND

Japanese Unexamined Patent Publication No. 2008-192574 discloses an electrical connector including a housing in which a plurality of contacts are arranged in a predetermined direction, a fixed shell which covers the housing, and a cover member which is rotatably mounted on the fixed shell. The housing includes a front wall portion having an insertion opening into which a flexible printed circuit (FPC) is inserted. A rotation axis of the cover member is located near the front wall portion to extend along the front wall portion.

SUMMARY

An example electrical connector is disclosed herein, including a main body comprising an insertion opening into which a connection target is inserted and an accommodation space to accommodate the connection target inserted into the insertion opening, a conductive contact held in the main body so as to be connected to the connection target in the accommodation space, and a cover member rotatably mounted on the main body to be rotatable around a rotation axis passing through the main body. The cover member may include a release operation portion configured to receive an external force to rotate the cover member around the rotation axis, and a restricting member configured to switch, in response to the rotation of the cover member, between a first state in which removal of the connection target from the accommodation space is restricted and a second state in which the connection target is released. The insertion opening may be spaced apart from, and opens away from, the rotation axis. A distance between the release operation portion and the insertion opening is less than a distance between the rotation axis and the insertion opening.

DETAILED DESCRIPTION

Figure 1:
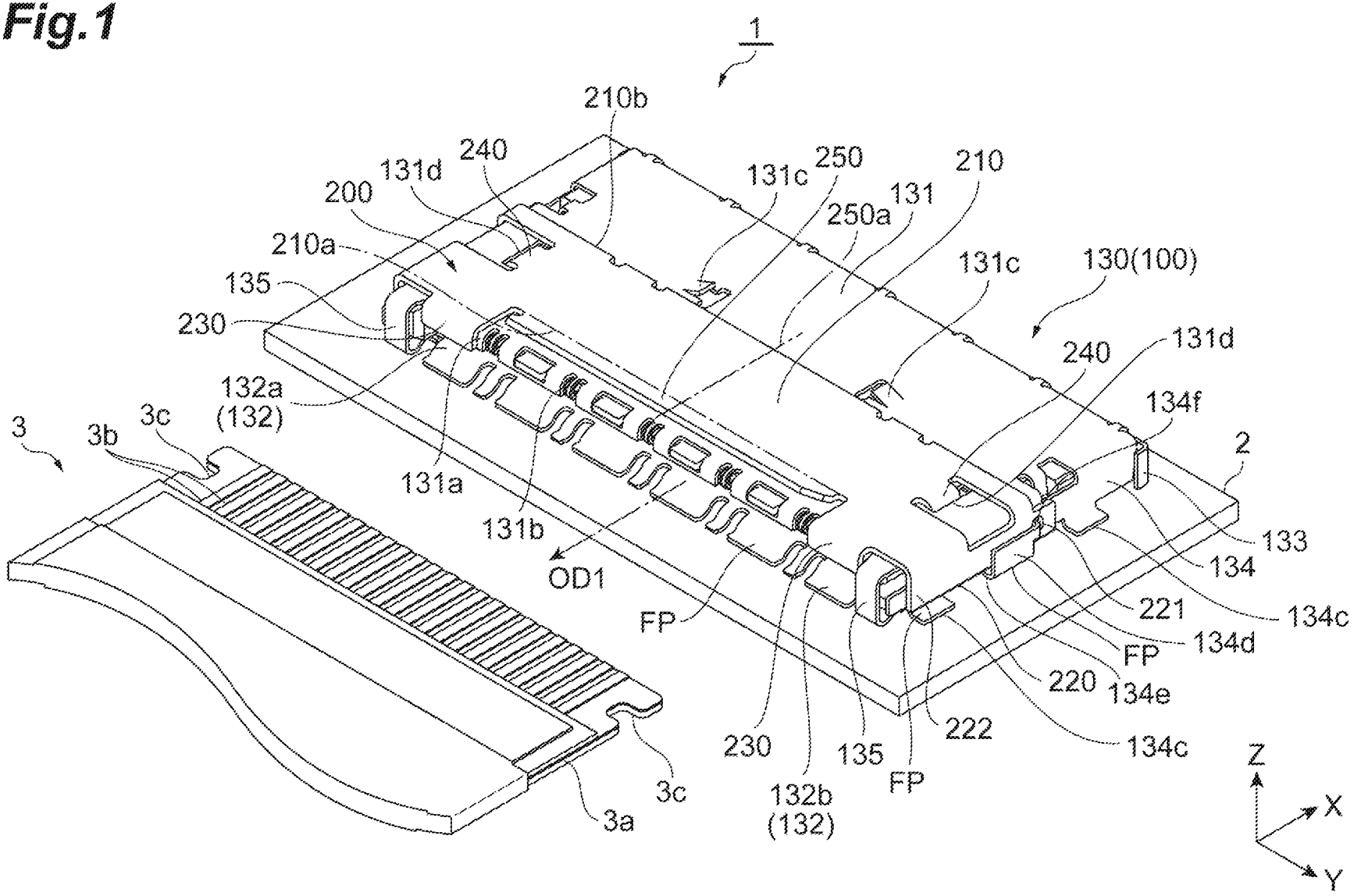
FIG. 1 is a perspective view illustrating an example electrical connector.

In the following description, with reference to the drawings, the same reference numbers are assigned to the same components or to similar components having the same function, and overlapping description is omitted. When an orthogonal coordinate system defined by an X-axis, a Y-axis, and a Z-axis is shown in the drawings, a positive direction of the Z-axis may be referred to as an "upward direction" and a negative direction of the Z-axis may be referred to as a "downward direction".

Figure 2:
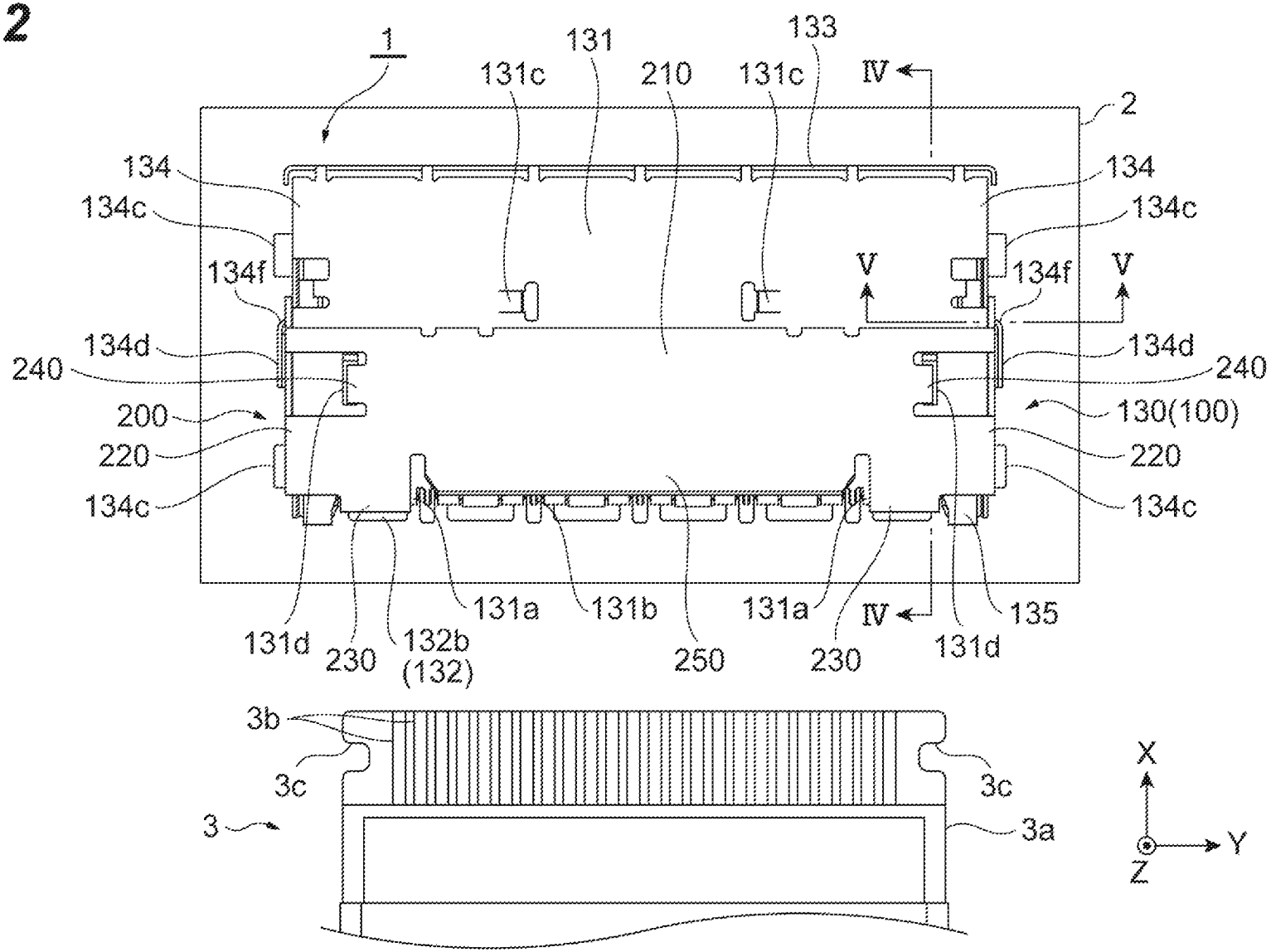
FIG. 2 is a top view illustrating the example electrical connector of FIG. 1.
Figure 3:
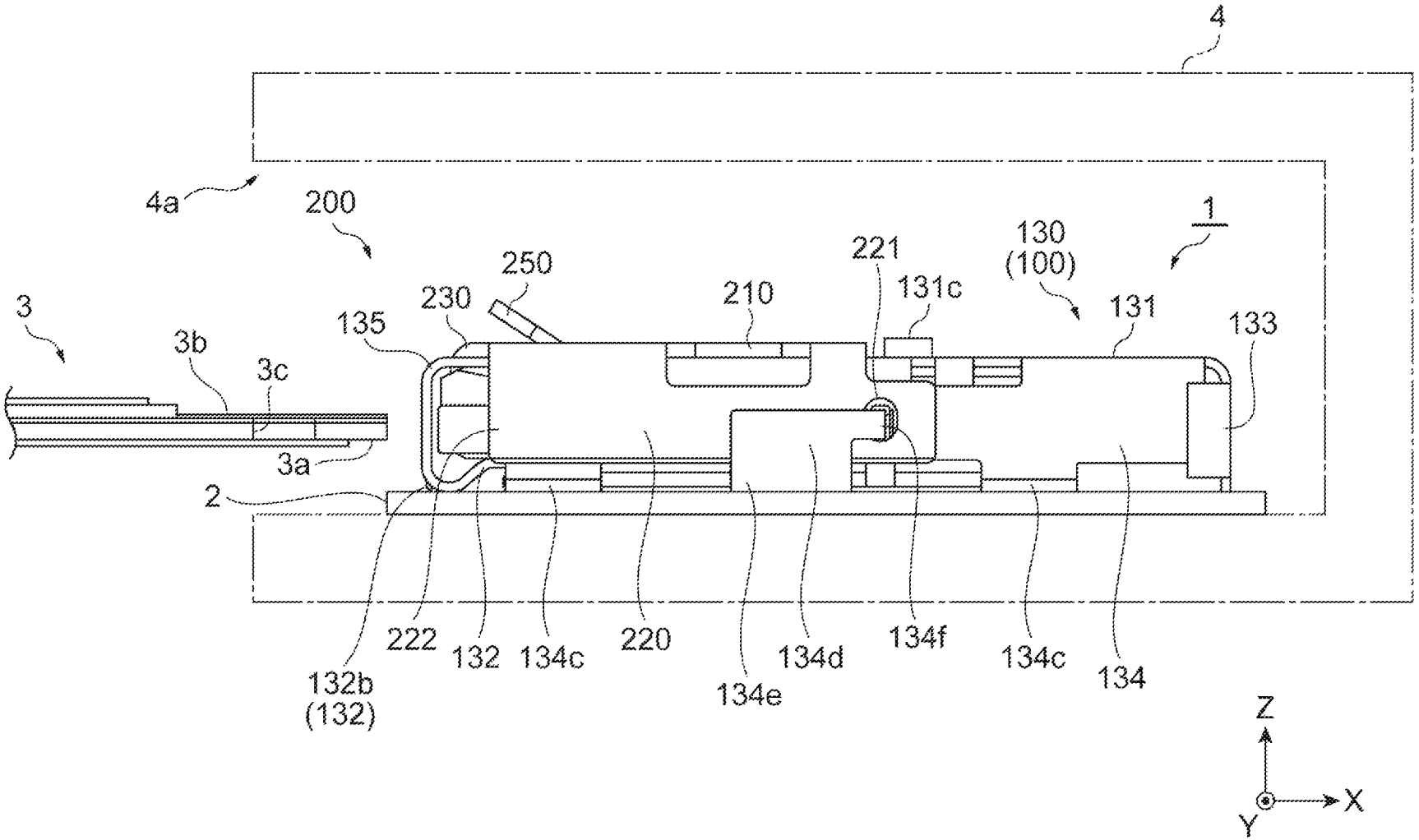
FIG. 3 is a side view illustrating the example electrical connector of FIG. 1.

An example electrical connector 1 will be described with reference to FIGS. 1 to 5. The electrical connector 1 includes a main body 100 and a cover member 200. The electrical connector 1 may be mounted on a circuit board 2 as shown in FIGS. 1 to 3. The electrical connector 1 may be configured so that a signal transmission medium 3 (a connection target) can be inserted and removed. In a state in which the signal transmission medium 3 is mounted on the electrical connector 1, an electrical signal is transmitted between the signal transmission medium 3 and the circuit board 2 via the electrical connector 1.

The circuit board 2 is configured so that an electronic circuit can be mounted thereon. The circuit board 2 may be, for example, a printed wiring board, a flexible printed board, or the like. The electrical connector 1 is mounted on a main surface of the circuit board 2 by solder connection or the like. The circuit board 2 may be disposed in a casing 4 having an opening portion 4*a*, for example, as shown in FIG. 3.

As shown in FIGS. 1 to 3, the signal transmission medium 3 has a flat plate shape and is configured so as to transmit an electrical signal. The signal transmission medium 3 may be, for example, a flexible flat cable (FFC), a flexible printed circuit (FPC), or the like. The signal transmission medium 3 includes an insulating base material 3*a* and a plurality of signal lines 3*b* (signal transmission members). A pair of cut-out portions 3*c* (recesses) are provided on each of side edges in the vicinity of a distal end of the insulating base material 3*a*. The plurality of signal lines 3*b* are disposed on an upper surface of the insulating base material 3*a* to be adjacent in a width direction (a Y-axis direction) of the insulating base material 3*a* and to extend in a lengthwise direction (an X-axis direction) of the insulating base material 3*a*.

Subsequently, an example configuration of the main body 100 will be described in more detail with reference to FIGS. 1 to 7. The main body 100 includes a housing 110, a plurality of contacts 120, and a shell 130.

Figure 4:
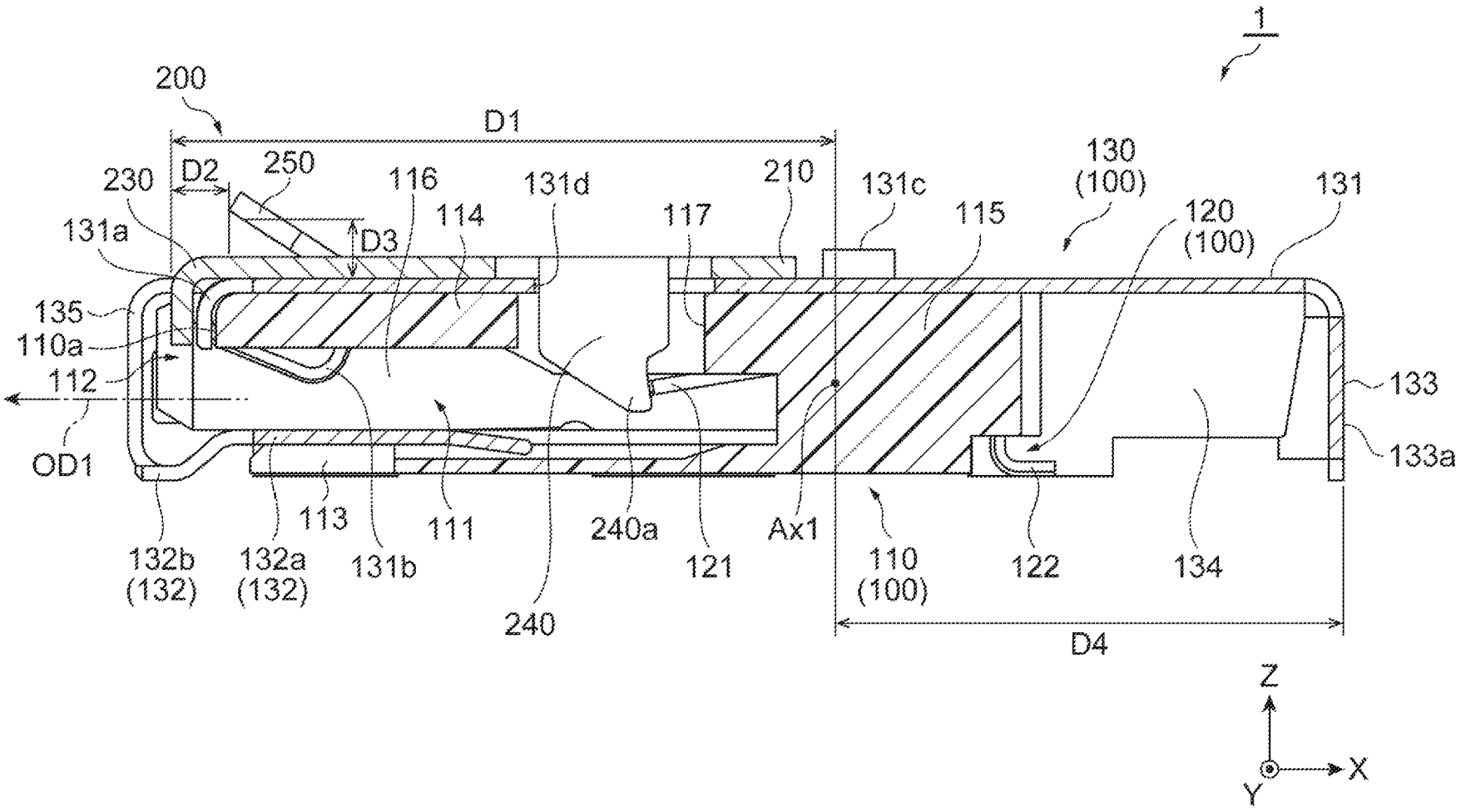
FIG. 4 is a cross-sectional view taken along line IV-IV of FIG. 2.

The housing 110 has an insulating property and has a rectangular parallelepiped shape. The housing 110 may be formed by, for example, resin molding. In some examples, as shown in FIG. 4, an accommodation space 111 capable of accommodating the signal transmission medium 3 is provided in the housing 110. Therefore, an insertion opening 112 of the signal transmission medium 3 is provided in a front portion of the housing 110 to communicate with the accommodation space 111.

The insertion opening 112 is a slit-shaped opening which is surrounded by a bottom wall portion 113, a top wall portion 114, a rear wall portion 115, and a pair of side wall portions 116 of the housing 110. The insertion opening 112 extends in a width direction of the housing 110 (the Y-axis direction). The top wall portion 114 extends between the insertion opening 112 and the rear wall portion 115. A pair of through holes 117 which extend through the top wall portion 114 to allow the outside to communicate with the accommodation space 111 are provided in the top wall portion 114.

The plurality of contacts 120 have conductivity and constitute a signal transmission line for transmitting an electrical signal between the signal transmission medium 3 and the circuit board 2. The plurality of contacts 120 may be, for example, metal members formed by bending. The plurality of contacts 120 are held by the housing 110.

The plurality of contacts 120 may be, for example, press-fitted into the housing 110 or may be integrally formed with the housing 110 (by insert molding). The plurality of contacts 120 are located adjacent to each other in the width direction of the housing 110 (the Y-axis direction). Therefore, the plurality of contacts 120 are arranged to respectively correspond to the plurality of signal lines 3*b* of the signal transmission medium 3.

In some examples, as shown in FIG. 4, a distal end portion 121 of each of the contacts 120 is located in the accommodation space 111 of the housing 110. When the signal transmission medium 3 is inserted into the accommodation space 111, the distal end portion 121 is physically and electrically connected to the signal line 3*b*. A base end portion 122 of the contact 120 extends to the outside of the rear wall portion 115 through the rear wall portion 115 located on the side opposite to the insertion opening 112. When the electrical connector 1 is mounted on the circuit board 2, the base end portion 122 is electrically and physically connected to a signal electrode of the circuit board 2 by, for example, soldering.

The shell 130 has conductivity and is configured to prevent leakage of electromagnetic waves from the contact 120 to the outside of the electrical connector 1. Additionally, the shell 130 may be configured to prevent mixing of noise into an electrical signal transmitted by the contact 120 due to the electromagnetic waves from outside the electrical connector 1. In some examples, the shell 130 serves as a noise shielding member, and may include a metal member formed by bending.

The shell 130 is mounted on the housing 110 to cover the housing 110, as shown in FIG. 4. As shown in FIGS. 1 to 7, the shell 130 includes a top plate 131, a bottom plate 132, a rear plate 133, and a pair of side plates 134 (side wall portions).

The top plate 131 covers the top wall portion 114 of the housing 110. As shown in FIGS. 1, 2, 4, 6, and 7, a pair of bent portions 131*a* (first locked portions) and a plurality of ground terminals 131*b* are provided at a front edge portion of the top plate 131. A pair of protruding pieces 131*c* (stopper portions) and a pair of through holes 131*d* (second locked portions) are provided on the top plate 131.

Figure 6:
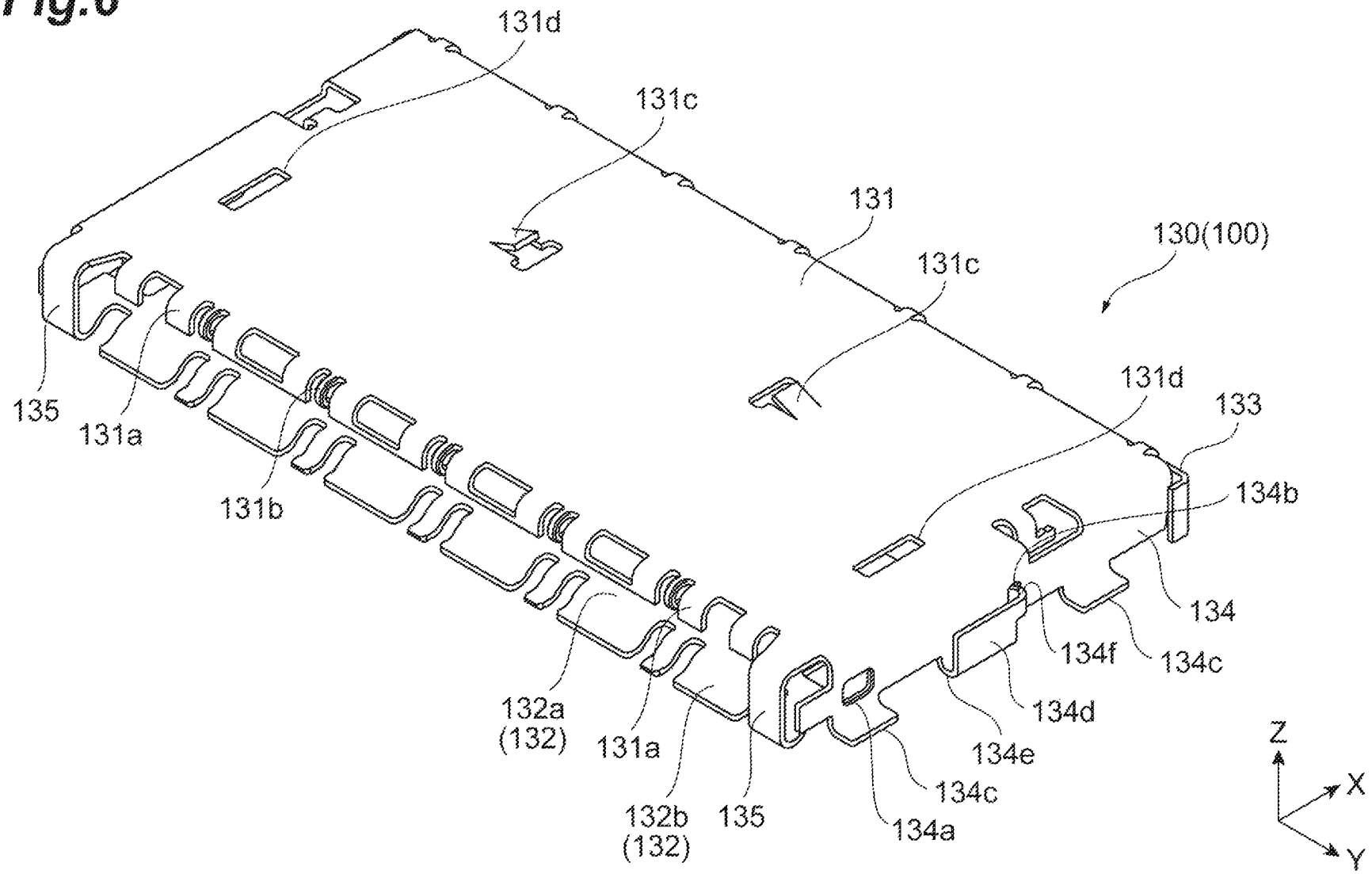
FIG. 6 is a perspective view illustrating an example main body.
Figure 7:
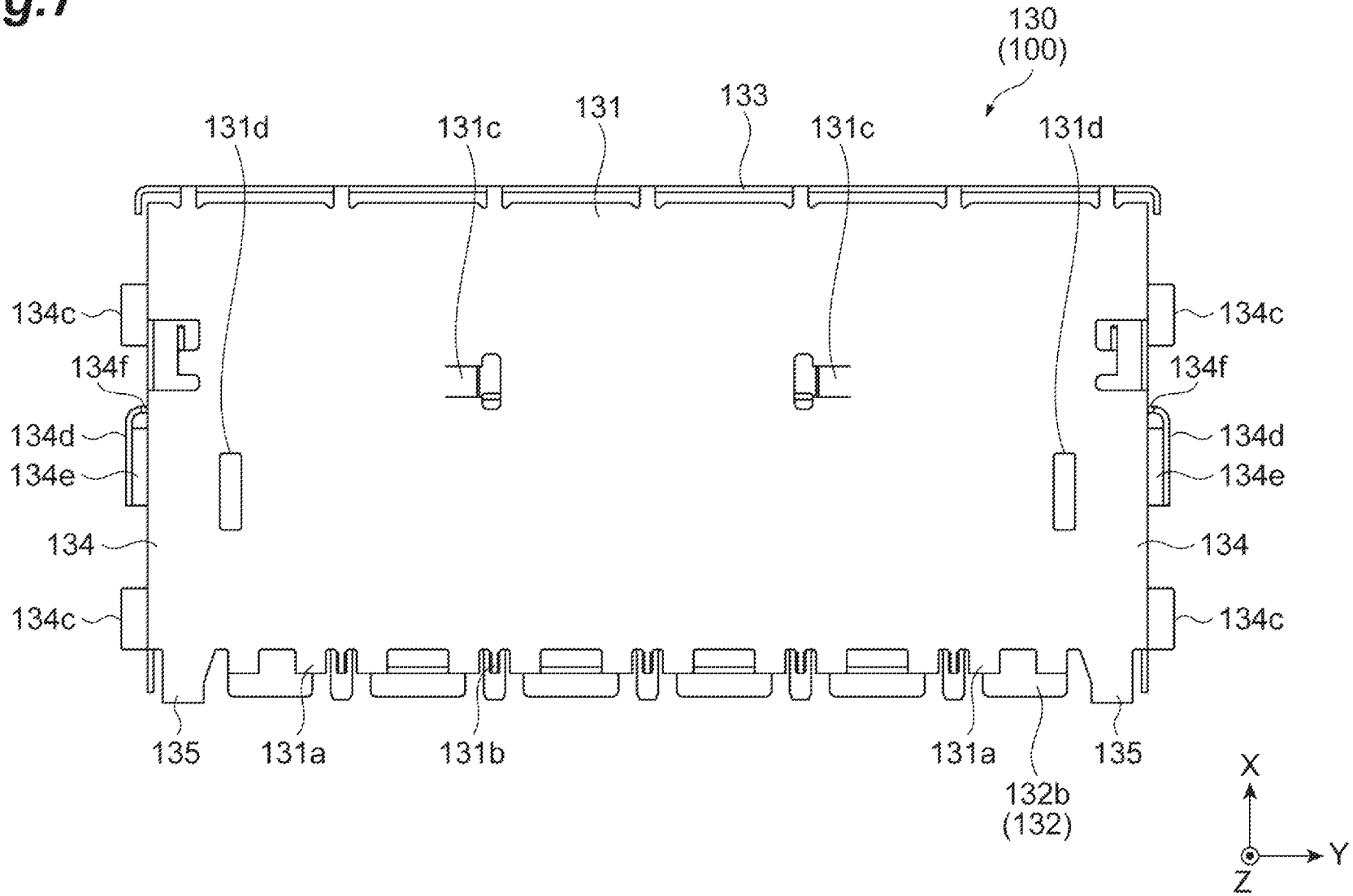
FIG. 7 is a top view illustrating the example main body of FIG. 6.

Each of the bent portions 131*a* extends toward the bottom plate 132 while bending from the vicinity of both ends in a width direction of the top plate 131 (the Y-axis direction), as shown in FIGS. 6 and 7. The pair of bent portions 131*a* cover a front edge portion of the housing 110 to such an extent that the bent portions 131*a* do not overlap the insertion opening 112 of the housing 110 (or cover at least part of an end face 110*a* of the main body 100 where the insertion opening 112 is located).

The plurality of ground terminals 131*b* are disposed adjacent to each other and are located between the pair of bent portions 131*a* in the width direction of the top plate 131 (the Y-axis direction). The plurality of ground terminals 131*b* are bent along the front edge portion of the housing 110 to the inside of the insertion opening 112, as shown in FIG. 4. When the signal transmission medium 3 is inserted into the accommodation space 111, the plurality of ground terminals 131*b* are physically and electrically connected to a ground transmission path of the signal transmission medium 3.

The pair of protruding pieces 131*c* are, for example, metal pieces obtained by cutting and bending a part of the top plate 131, as shown in FIGS. 1 and 6. As will be described in further detail later, the pair of protruding pieces 131*c* serve as stoppers which limit a rotation range of the cover member 200. For example, the cover member 200 may be configured to come into contact with the pair of protruding pieces 131*c* when an elevation angle of the cover member 200 reaches a predetermined size, such that the pair of protruding pieces 131*c* hinder rotation of the cover member 200.

The pair of protruding pieces 131*c* are arranged in the width direction of the top plate 131 (the Y-axis direction). The pair of protruding pieces 131*c* may be located at a center portion of the top plate 131 in the width direction of the top plate 131 (the Y-axis direction). Here, when it is assumed that a width of the top plate 131 is A, the "center portion" may be within a range of 0.2 A to 0.8 A from one side edge (for example, a left end edge of FIGS. 2 and 7) of the top plate 131 in the width direction of the top plate 131 (the Y-axis direction).

One of protruding pieces 131*c* (a first protruding piece) may be located in a range of 0.2 A to 0.4 A from one side edge (for example, the left end edge in FIGS. 2 and 7) of the top plate 131 in the width direction of the top plate 131 (the Y-axis direction). The other one of the protruding pieces 131*c* (a second protruding piece) may be located in a range of 0.6 A to 0.8 A from one side edge (for example, the left end edge in FIGS. 2 and 7) of the top plate 131 in the width direction of the top plate 131 (the Y-axis direction).

As shown in FIGS. 1, 2, 6, and 7, the pair of through holes 131*d* are arranged in the width direction of the top plate 131 (the Y-axis direction). Each of the through holes 131*d* corresponds to a through hole 117 provided in the top wall portion 114 of the housing 110. Therefore, as particularly shown in FIG. 4, each of the through holes 131*d* communicates with the corresponding through hole 117.

The bottom plate 132 is disposed to face the top plate 131 in a height direction of the main body 100 (the Z-axis direction), as shown in FIG. 4. The bottom plate 132 is integrally connected to the top plate 131 via a pair of connecting portions 135.

As shown in FIG. 4, a main portion 132*a* of the bottom plate 132 is located in the accommodation space 111 to extend along the bottom wall portion 113 of the housing 110. When the signal transmission medium 3 is inserted into the accommodation space 111, the main portion 132*a* of the bottom plate 132 is physically and electrically connected to the ground transmission path of the signal transmission medium 3.

A plurality of bent pieces 132*b* are provided at a distal end edge of the main portion 132*a*. The plurality of bent pieces 132*b* are bent toward the side away from the top plate 131 while protruding outward in a depth direction of the main body 100 (the X direction). The plurality of bent pieces 132*b* constitute fixing portions FR In some examples, in a state in which the electrical connector 1 is mounted on the circuit board 2, each of the plurality of bent pieces 132*b* is electrically and physically connected to a ground electrode of the circuit board 2 by, for example, soldering.

The rear plate 133 covers the rear wall portion 115 at a position away from the rear wall portion 115 of the housing 110, as shown in FIG. 4. Therefore, the base end portion 122 of the contact 120 is located in a space between the rear plate 133 and the rear wall portion 115.

Each of the side plates 134 covers the side wall portion 116 of the housing 110 as shown in FIGS. 1 to 3 and 5 to 7. Since the pair of side plates 134 have a substantially mirror-symmetric relationship with each other, only a configuration of one side plate 134 (a first side plate) will be described below, and description of the other side plate 134 (a second side plate) will be omitted.

As shown in FIG. 6, a recess 134*a* (a first engaging portion, a third engaging portion, a state maintaining portion) which is recessed inward is provided in the vicinity of a distal end portion of the side plate 134. The recess 134*a* is configured to be able to accommodate a protruding portion 222*a* which will be described in additional detail later. The recess 134*a* may have, for example, a rectangular shape, a circular shape, or an elliptical shape. Instead of the recess 134*a*, a through hole which passes through the side plate 134 may be provided in the side plate 134 in some examples.

Figure 5:
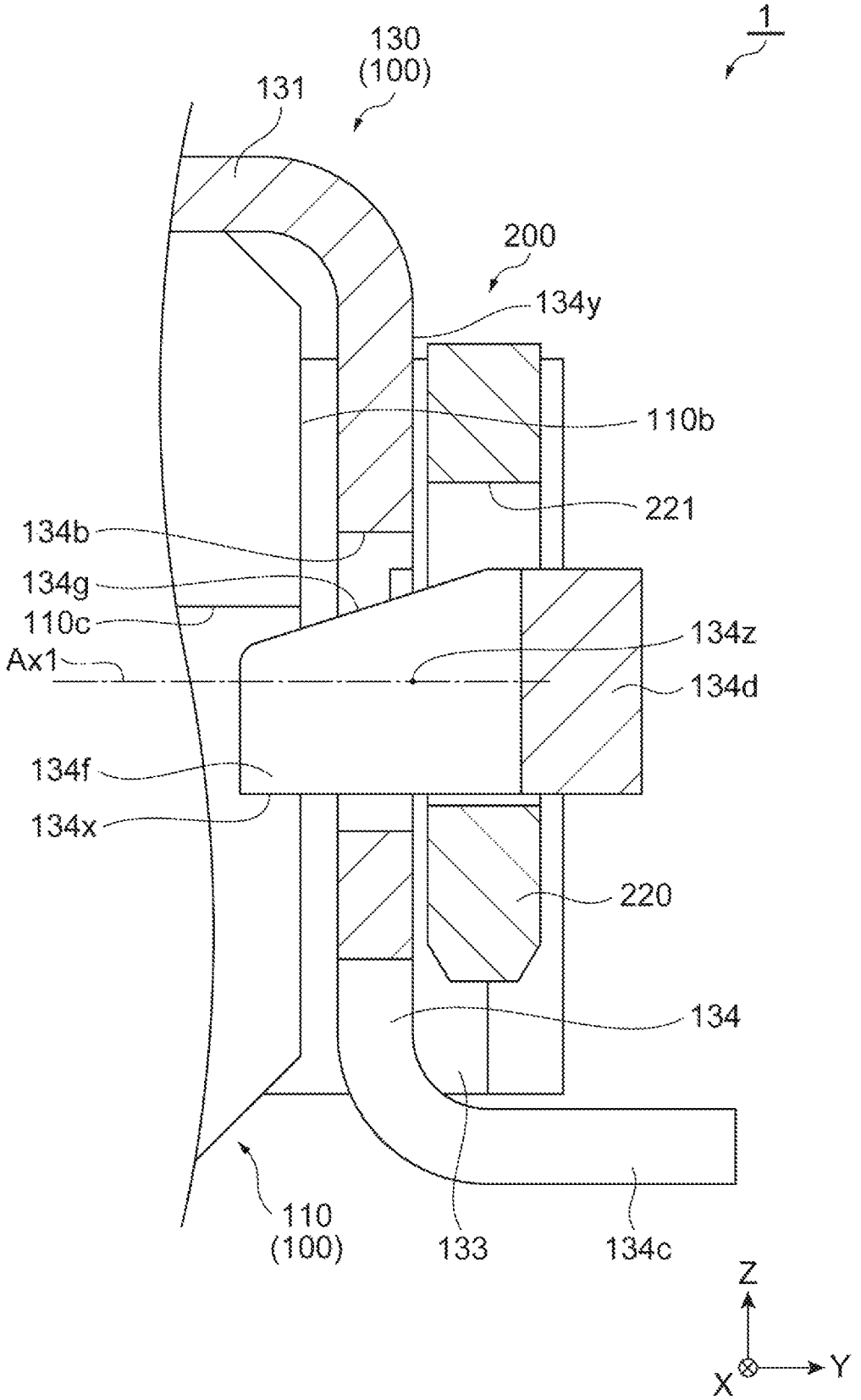
FIG. 5 is a cross-sectional view taken along line V-V of FIG. 2.

A through hole 134*b* (a bearing hole, an opening portion) is provided in the side plate 134 as shown in FIGS. 5 and 6. The through hole 134*b* may have a rectangular shape which extends lengthwise in the height direction of the main body 100 (the Z-axis direction). The through hole 134*b* may be located in a center portion of the side plate 134 in the depth direction of the main body 100 (the X-axis direction) or may be located closer to the insertion opening 112 than the center portion of the side plate 134 in the depth direction of the main body 100 (the X-axis direction).

A plurality of bent pieces 134*c* are provided on a lower end edge of the side plate 134. The plurality of bent pieces 134*c* also constitutes fixing portions FP. The plurality of bent pieces 134*c* are bent from the side plate 134 to protrude outward in the width direction of the main body 100 (the Y direction).

An auxiliary plate 134*d* (an auxiliary wall portion) is provided at a lower end edge of the side plate 134 to be bent from the lower end edge. In some examples, the auxiliary plate 134*d* is integrally connected to the side plate 134 via the bent portion 134*e*. The bent portion 134*e* may constitute the fixing portion FP to the circuit board 2 as described above. For example, the auxiliary plate 134*d* faces the side plate 134 in the width direction of the main body 100 (the Y-axis direction). When the electrical connector 1 is mounted on the circuit board 2, the auxiliary plate 134*d* and the bent portion 134*e* may be electrically and physically connected to the ground electrode of the circuit board 2 by, for example, soldering. Therefore, the auxiliary plate 134*d* and the bent portion 134*e* may serve as a fixing portion which is fixed to the circuit board 2.

A rotation shaft 134*f* is provided on a side edge of the auxiliary plate 134*d*. The rotation shaft 134*f* may be obtained by bending a part of the auxiliary plate 134*d* so that the rotation shaft 134*f* extends in the width direction of the main body 100 (the Y-axis direction) from the auxiliary plate 134*d* toward the side plate 134. A distal end of the rotation shaft 134*f* is inserted into the through hole 134*b*. In some examples, the distal end of the rotation shaft 134*f* is engaged with the through hole 134*b*.

With reference to FIG. 5, the distal end of the rotation shaft 134*f* may pass through the through hole 134*b* to approach the housing 110. Therefore, the rotation shaft 134*f* may be located at the center portion of the side plate 134 in the depth direction of the main body 100 (the X-axis direction) or may be located closer to the insertion opening 112 than the center portion of the side plate 134 in the depth direction of the main body 100 (the X-axis direction), similarly to the through hole 134*b*.

The rotation shaft 134*f* includes an inclined portion 134*g* (a side edge portion) as shown in FIG. 5. The inclined portion 134*g* (a portion which faces the top plate 131 side) may include a peripheral edge of the rotation shaft 134*f* which faces the side opposite to the bent portion 134*e*. The inclined portion 134*g* is inclined toward the bent portion 134*e* such that the height of the rotation shaft 134*f* decreases in the direction of the distal end portion of the rotation shaft 134*f*. In some examples, the rotation shaft 134*f* has a tapered shape.

Subsequently, an example configuration of the cover member 200 will be described in more detail with reference to FIGS. 1 to 5, 8 and 9. The cover member 200 is rotatably mounted on the main body 100 so as to be rotatable around a rotation axis Ax1. For example, both ends of the cover member 200 in a direction along the rotation axis Ax1 (a pair of side plates 220) is mounted on the main body 100 so as to rotate around the rotation axis Ax1. The insertion opening 112 is spaced apart from, and opens away from, the rotation axis Ax1. The insertion opening 112 opens in a direction OD1 which is a direction away from the rotation axis Ax1. A plurality of contacts 120 are held by the main body 100 so as to be arranged along the rotation axis Ax1. The plurality of signal lines 3*b* are arranged along the rotation axis Ax1. Each of the plurality of contacts 120 are connected to one of the plurality of signal lines 3*b* in the accommodation space 111. The insertion opening 112 extends in a slit shape along the rotation axis Ax1. The main body 100 comprises a side face 134*y* (an outer face of the side plate 134) intersecting (for example, orthogonally intersecting) the rotation axis Ax1 at an intersection 134*z*. The through hole 134*b* is formed at the intersection 134*z* of the rotation axis Ax1 and the side face 134*y*. The recess 134*a* is provided on the side face 134. The main body 100 comprises a back face 133*a* (an outer face of the back plate 133) which faces away from the opening direction OD1 of the insertion opening 112. A distance D1 between the rotation axis Ax1 and the insertion opening 112 may be less than or equal to a distance D4 between the rotation axis Ax1 and the back face 133. The cover member 200 includes a main plate 210, the pair of side plates 220 (both ends of the cover member 200), a bent portion 230 (a first locking portion), a pair of restricting members 240 (a second locking portion), and a release operation portion 250. The cover member 200 may be, for example, a metal member formed by bending.

The main plate 210 protrudes toward the opening direction OD1 of the insertion opening 112 from a base end portion 210*b* along the rotation axis Ax1, overlaps the main body 100 in a first state which will be described later, and is separated from the main body 100 in a second state which will be described later. The base end portion 210*b* is located between the rotation axis Ax1 and a distal end of the main plate 210. In the first state, the base end portion 210*b* is located between the rotation axis Ax1 and the insertion opening 112. In the second state, The base end portion 210*b* of the main plate 210 comes in contact with the pair of protruding pieces 131*c*. Thus, a displacement of the main plate 210 away from the main body 100 is restricted. The pair of protruding pieces 131*c* are located between the both ends 220 of the cover member 200 in a direction along the rotation axis Ax1. The main plate 210 extends in the width direction of the cover member 200 (the Y-axis direction), as shown in FIGS. 1 and 2. In a state in which the cover member 200 overlaps the top plate 131 (when the cover member 200 is closed with respect to the main body 100), the main plate 210 covers a region of the top plate 131 which is closer to the insertion opening 112 than the protruding piece 131*c*.

As shown in FIGS. 1, 3, 8, and 9, each of the side plates 220 extends toward the main body 100 while being bent from both side edges of the main plate 210. A shaft hole 221 which is a through hole passing through the side plate 220 is provided at a rear end portion of the side plate 220 (an end portion on the rear plate 133 side). With reference to FIGS. 1 and 3, the rotation shaft 134*f* is inserted into the shaft hole 221. Therefore, the cover member 200 is mounted on the main body 100 (the shell 130) to be rotatable around the rotation shaft 134*f*. The rotation shaft 134*f* extends into the through hole 134*b* via the shaft hole 221. The rotation shaft 134*f* may extend into the housing 110 (for example, into a recess 110*c* formed on the side face 110*b* of the housing 110) via the shaft hole 221 and the through hole 134*b*. The rotation shaft 134*f* comprises a first edge portion which faces toward the bent portion 134*e* and a second edge portion (the inclined portion 134*g* as described above) which faces away from the bent portion 134*e*. The first edge portion 134*x* may be parallel to the rotation axis Ax1. The second edge 134*g* may be inclined with respect to the rotation axis Ax1 so that a distance between the second edge portion 134*g* and the first edge portion 134*x* gradually decreases toward the distal end of the rotation shaft 134*f*.

Figure 8:
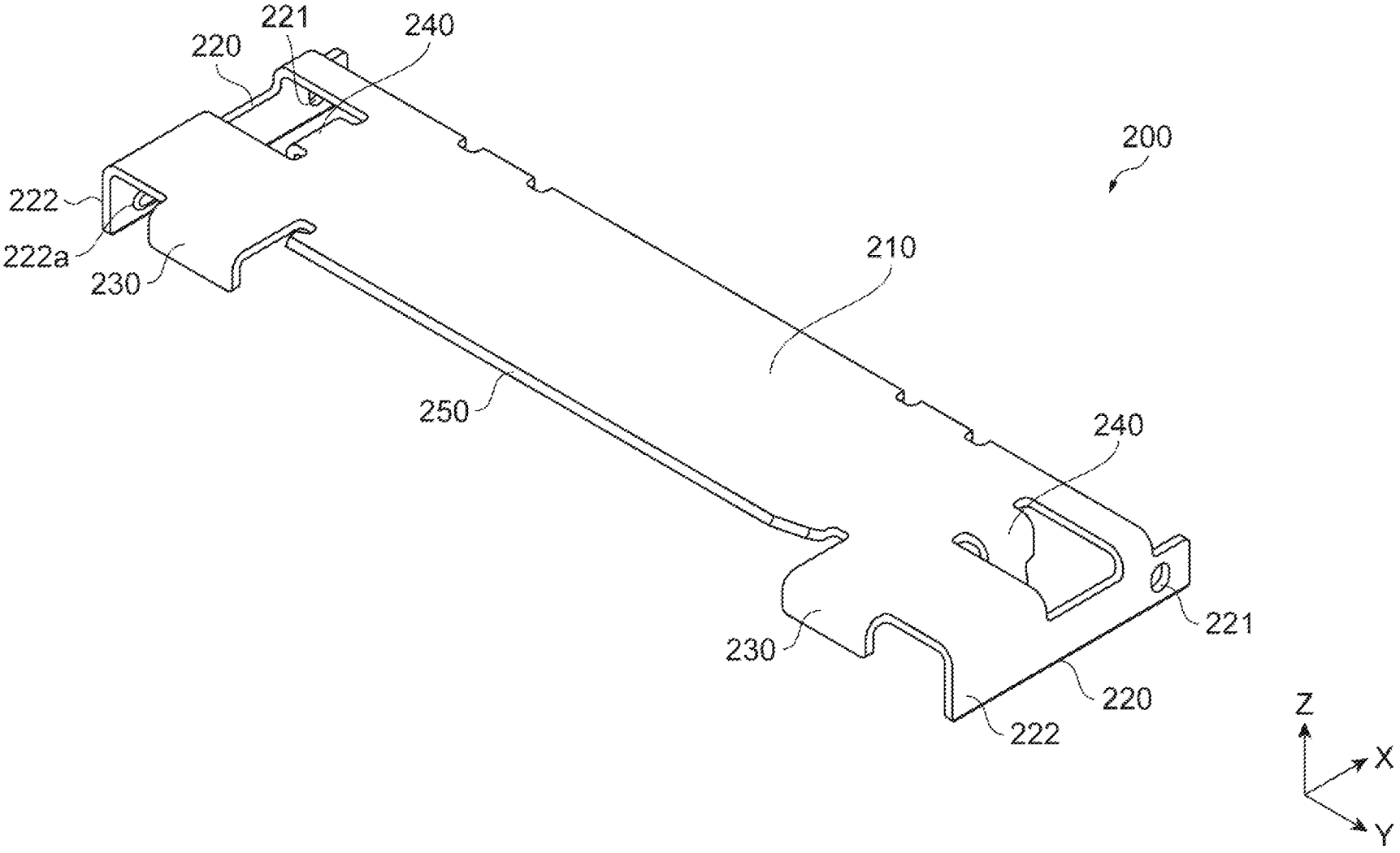
FIG. 8 is a perspective view illustrating an example cover member when seen from above.
Figure 9:
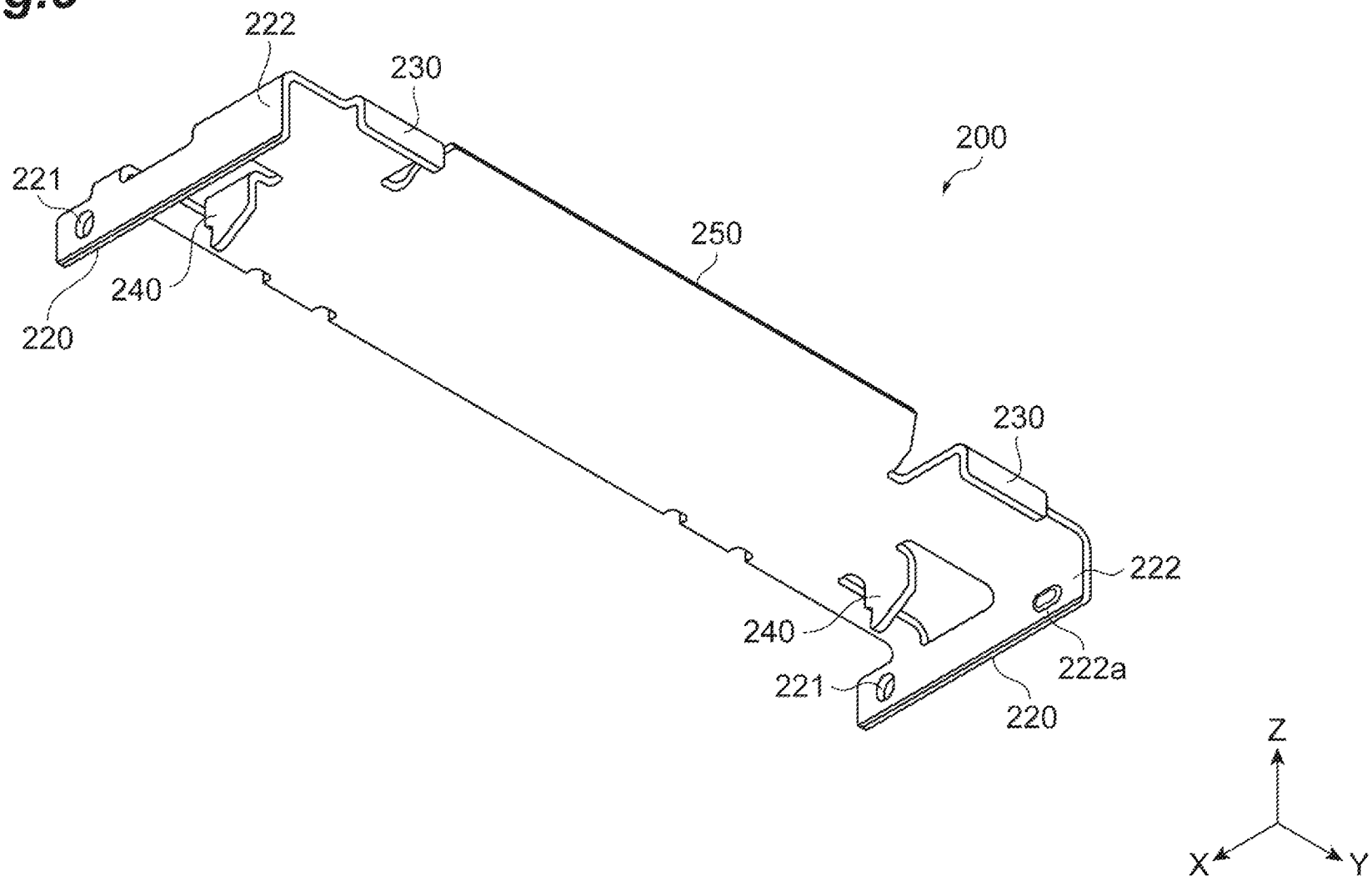
FIG. 9 is a perspective view illustrating the example cover member of FIG. 8 when seen from below.

As shown in FIGS. 8 and 9, a protruding portion 222*a* (a second engaging portion, a fourth engaging portion, a state maintaining portion) which protrudes inward from an inner wall surface of the side plate 220 is provided in the vicinity of a distal end portion 222 of the side plate 220. The protruding portion 222*a* is engaged with the recess 134*a* in the first state. The protruding portion 222, while engaging with the recess 134*a*, oppose a positional displacement of the main plate 210 from the first state to the second state. With reference to FIGS. 1 and 3, in a state in which the cover member 200 overlaps the top plate 131 (when the cover member 200 is closed with respect to the main body 100), the protruding portion 222*a* is engaged with the recess 134*a* by being accommodated in the recess 134*a*. The protruding portion 222*a* may be formed by embossing the side plate 220, for example. A protruding height of the protruding portion 222*a* may be equal to or less than a half of a thickness of the side plate 220 or may be smaller than a depth of the recess 134*a*.

Each of the bent portions 230 extends toward the main body 100 while being bent from the vicinity of both ends of the cover member 200 in the width direction (the Y-axis direction), as shown in FIGS. 8 and 9. In the state in which the cover member 200 overlaps the top plate 131 (when the cover member 200 is closed with respect to the main body 100), the pair of bent portions 230 cover surfaces of the bent portions 131*a* to such an extent that the bent portions 230 do not overlap with the insertion opening 112 of the housing 110. In some examples, each of the bent portions 230 is locked by the corresponding bent portion 131*a*.

The restricting member 240 switches, in response to a rotation of the cover member 200 around the rotation axis Ax1, the first state in which removal of the signal transmission medium 3 from the accommodation space 111 is restricted and the second state in which the signal transmission medium 3 is released. The restricting member 240 is provided on the main plate 210. The main body 100 comprises a through hole (the through holes 117 and 131*d*). An end portion 240*a* of the restricting member 240 protrudes into the accommodation space 111 in the first state. The end portion 240*a* of the restricting member 240 is located in the cut-out portions 3*c* in the first state and is located out of the cut-out portions 3*c* in the second state. The plurality of contacts 120 are sandwiched between the two restricting members 240 along the rotation axis Ax1. The pair of restricting members 240 are, for example, metal pieces obtained by cutting and bending a part of the main plate 210 as shown in FIGS. 8 and 9. The pair of restricting members 240 are configured to lock the signal transmission medium 3 inserted into the insertion opening 112 and thus to restrict removal of the signal transmission medium 3 from the housing 110 (as described in additional detail later).

The pair of restricting members 240 are arranged in a width direction of the main plate 210 (the Y-axis direction). With reference to FIGS. 1, 2, and 4, in the state in which the cover member 200 overlaps the top plate 131 (when the cover member 200 is closed with respect to the main body 100), the pair of restricting members 240 are respectively inserted into the corresponding through holes 117 and 131*d*. In some examples, the pair of restricting members 240 are respectively locked in the corresponding through holes 117 and 131*d* such that a distal end portion of each of the restricting members 240 is located in the accommodation space 111.

The release operation portion 250 is configured to receive an external force to rotate the cover member 200 around the rotation axis Ax1. The release operation portion 250 is configured to perform an operation for releasing a lock (described in additional detail later) between the signal transmission medium 3 and the restricting member 240. A position where the two protruding pieces 131*c* come in contact with the base end portion 210*b* and a width of the release operation portion 250 overlap with each other in a direction along the rotation axis Ax1. A center of the release operation portion 250 is located between the two protruding pieces 131*c* along the rotation axis Ax1. A distance D2 between the release operation portion 250 and the insertion opening 112 is less than a distance D1 between the rotation axis Ax1 and the insertion opening 112. The release operation portion 250 is provided on a distal end of the main plate 210 opposite to the base end portion 210*b*. The release operation portion 250 extends in the width direction of the main plate 210 (the Y-axis direction). The release operation portion 250 is bent from a distal end edge of the main plate 210, so as to be bent away from the main body 100 toward a distal end thereof and thus to be easily gripped by an operator. In some examples, in the state in which the cover member 200 overlaps the top plate 131 (when the cover member 200 is closed with respect to the main body 100), the release operation portion 250 is located closer to the insertion opening 112 than the rotation shaft 134*f*. The release operation portion 250 is formed so as to be apart from the main body 100 toward the opening direction OD1 of the insertion opening 112. A distance D3 between the release operation portion 250 and the main body 100 increases gradually toward the opening direction OD1. This configuration facilitates gripping by an operator.

Example Method of Mounting a Cover Member on Main Body

Subsequently, a method of mounting the cover member 200 on the main body 100 will be described with reference to FIGS. 10, 11A, and 11B.

Figure 10:
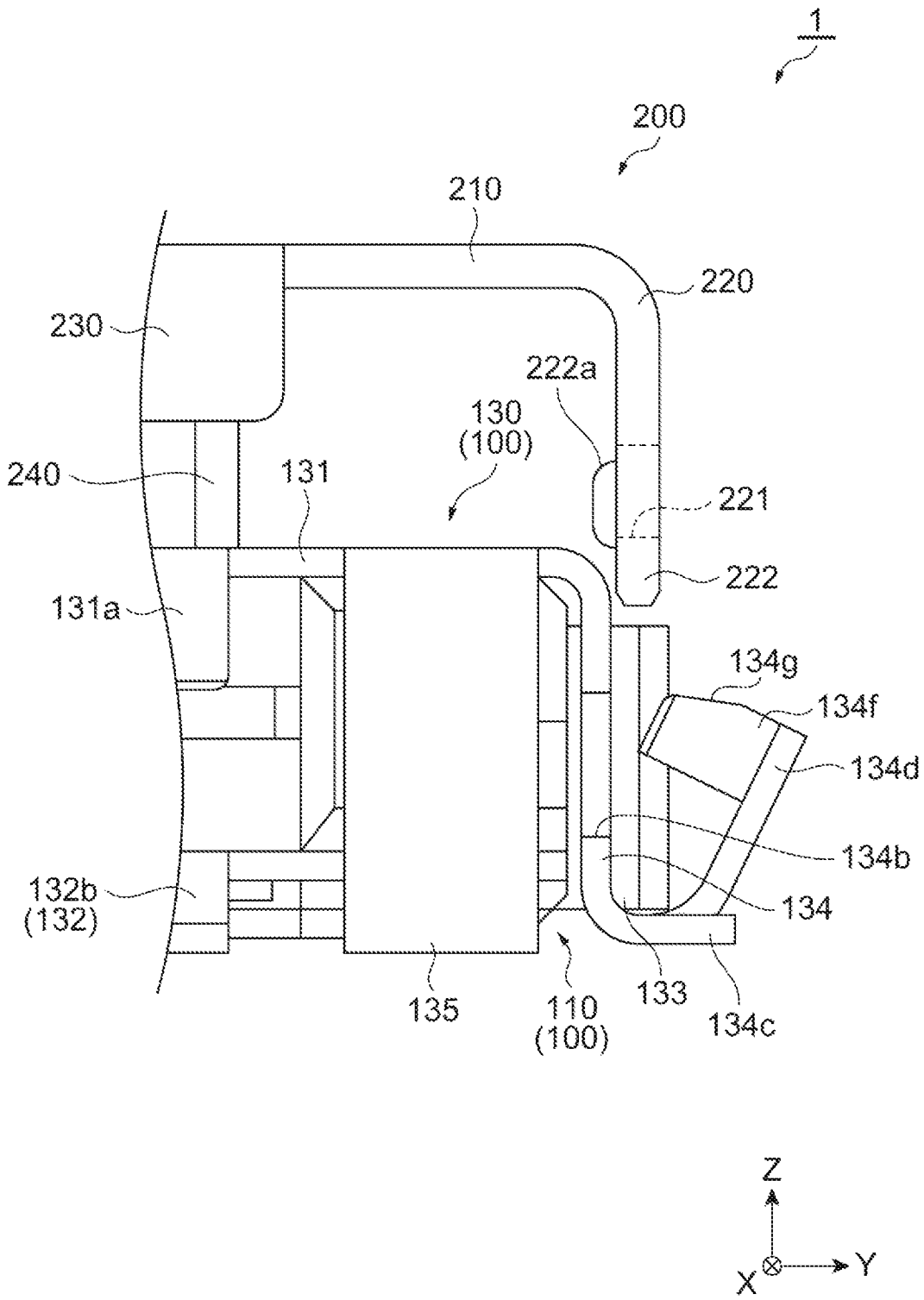
FIG. 10 illustrates an example of the cover member mounted on the main body.

First, as shown in FIG. 10, the auxiliary plate 134*d* is inclined with respect to the bent portion 134*e* so that a distal end of the auxiliary plate 134*d* is tilted away from the side plate 134. Therefore, the rotation shaft 134*f* is located outside the through hole 134*b*. Additionally, a linear distance between the distal end of the rotation shaft 134*f* and the side plate 134 may be set smaller than a thickness of the side plate 220.

Figure 11A:
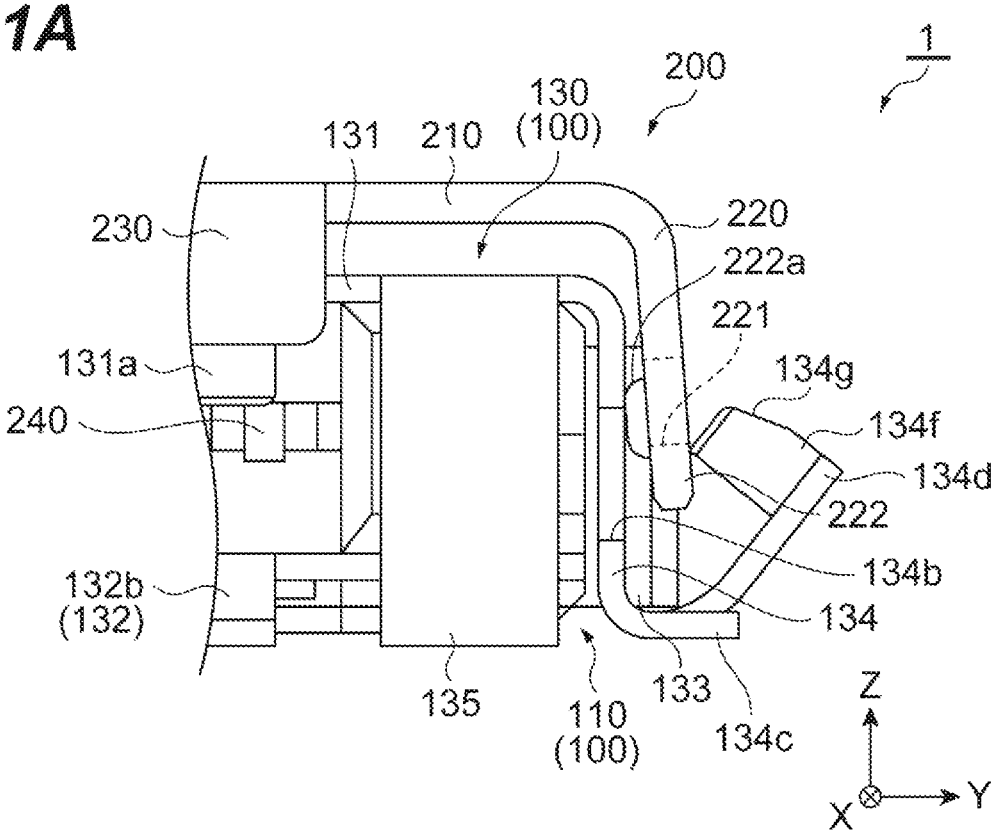
FIGS. 11A and 11B illustrate another example of the cover member mounted on the main body.
Figure 11B:
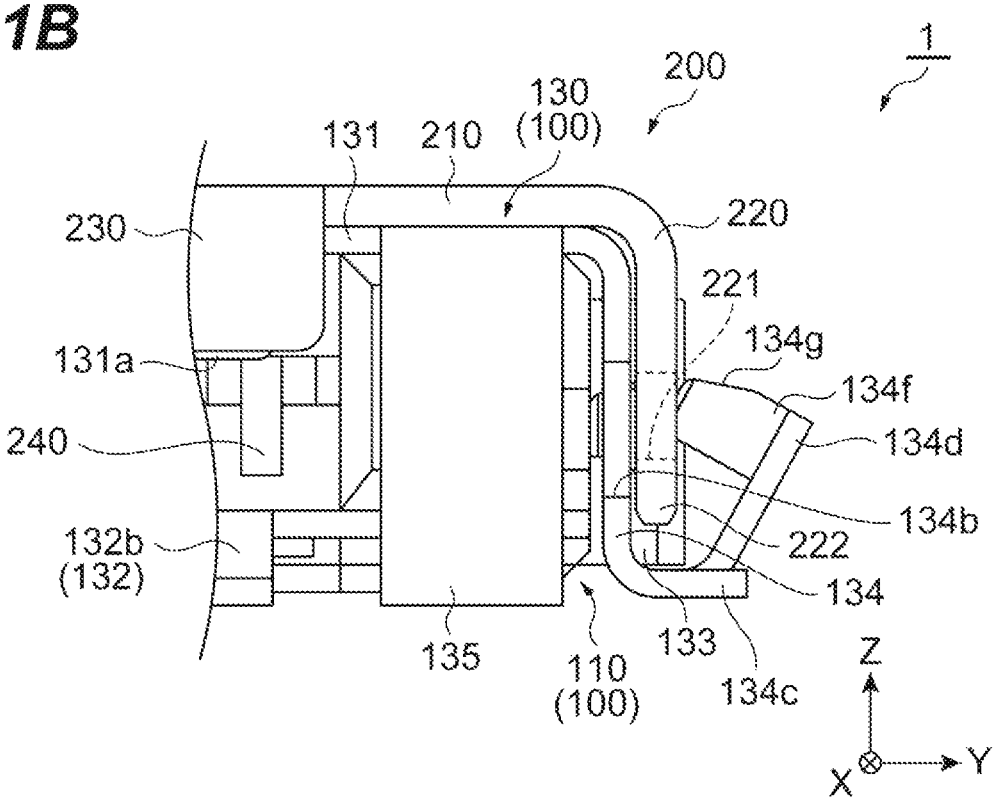

When the cover member 200 is moved closer to the main body 100 from the vicinity of the top plate 131, as shown in FIG. 11A, the side plate 220 comes into contact with the inclined portion 134*g* of the rotation shaft 134*f* and pushes the auxiliary plate 134*d* outward. When the cover member 200 is further moved closer to the main body 100 and the distal end of the rotation shaft 134*f* overlaps the shaft hole 221 of the side plate 220, as shown in FIG. 11B, the auxiliary plate 134*d* and the rotation shaft 134*f* return to the configuration illustrated in FIG. 10 due to a spring property of the auxiliary plate 134*d*, and thus the distal end of the rotation shaft 134*f* is naturally inserted into the shaft hole 221.

Thereafter, as shown in FIG. 5, the rotation shaft 134*f* is inserted into the shaft hole 221 and is engaged with the through hole 134*b* by pushing the rotation shaft 134*f* into the through hole 134*b*.

Accordingly, the cover member 200 is mounted on the main body 100 to be rotatable around the rotation shaft 134*f*. Thus, the electrical connector 1 is completed.

Method of Mounting a Signal Transmission Medium in the Electrical Connector

Next, an example method of mounting the signal transmission medium 3 in the electrical connector 1 will be described with reference to FIGS. 12 to 15.

Figure 12:
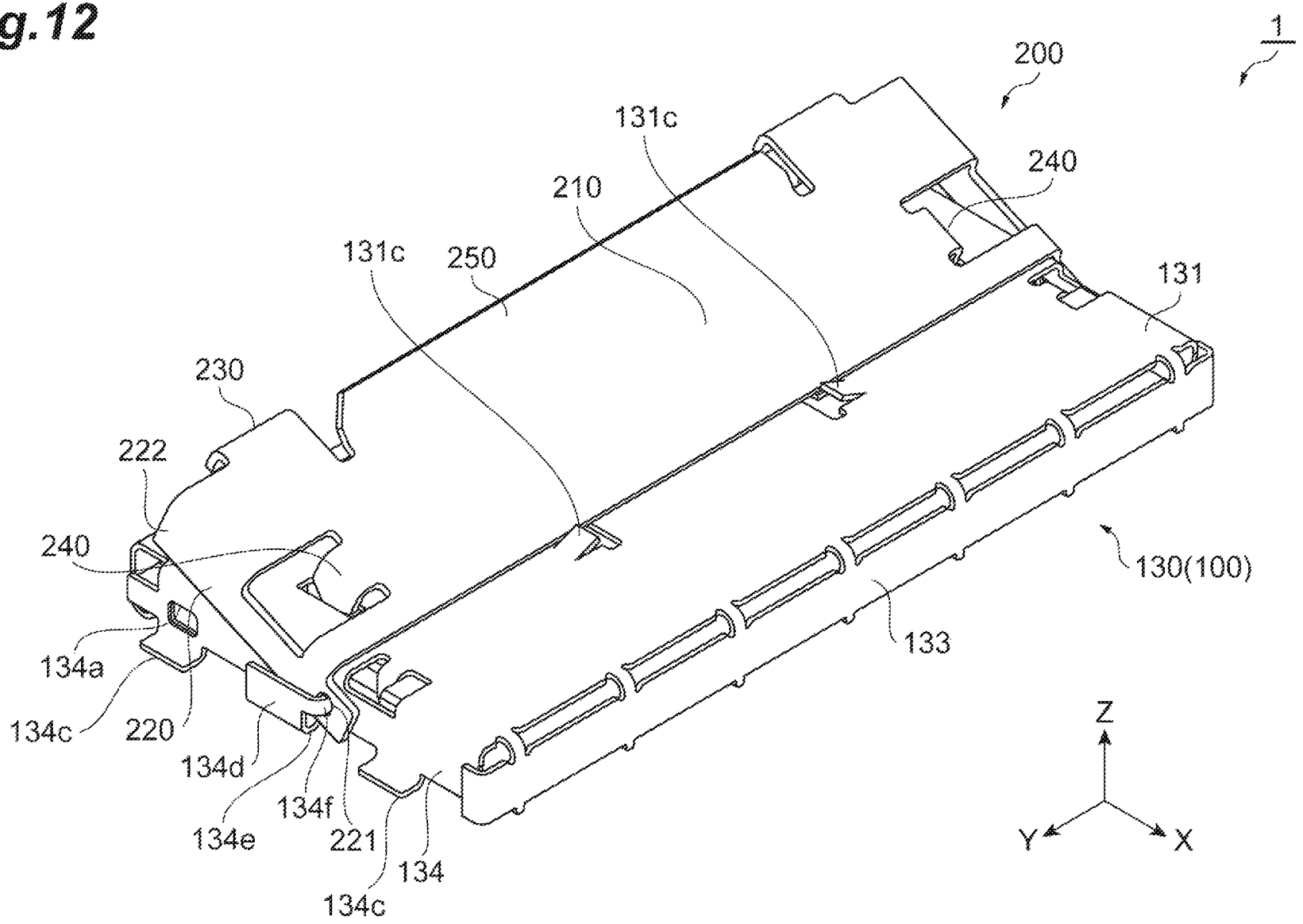
FIG. 12 is a perspective view of an example electrical connector in a state in which the cover member is open with respect to the main body when seen from rear.
Figure 13:
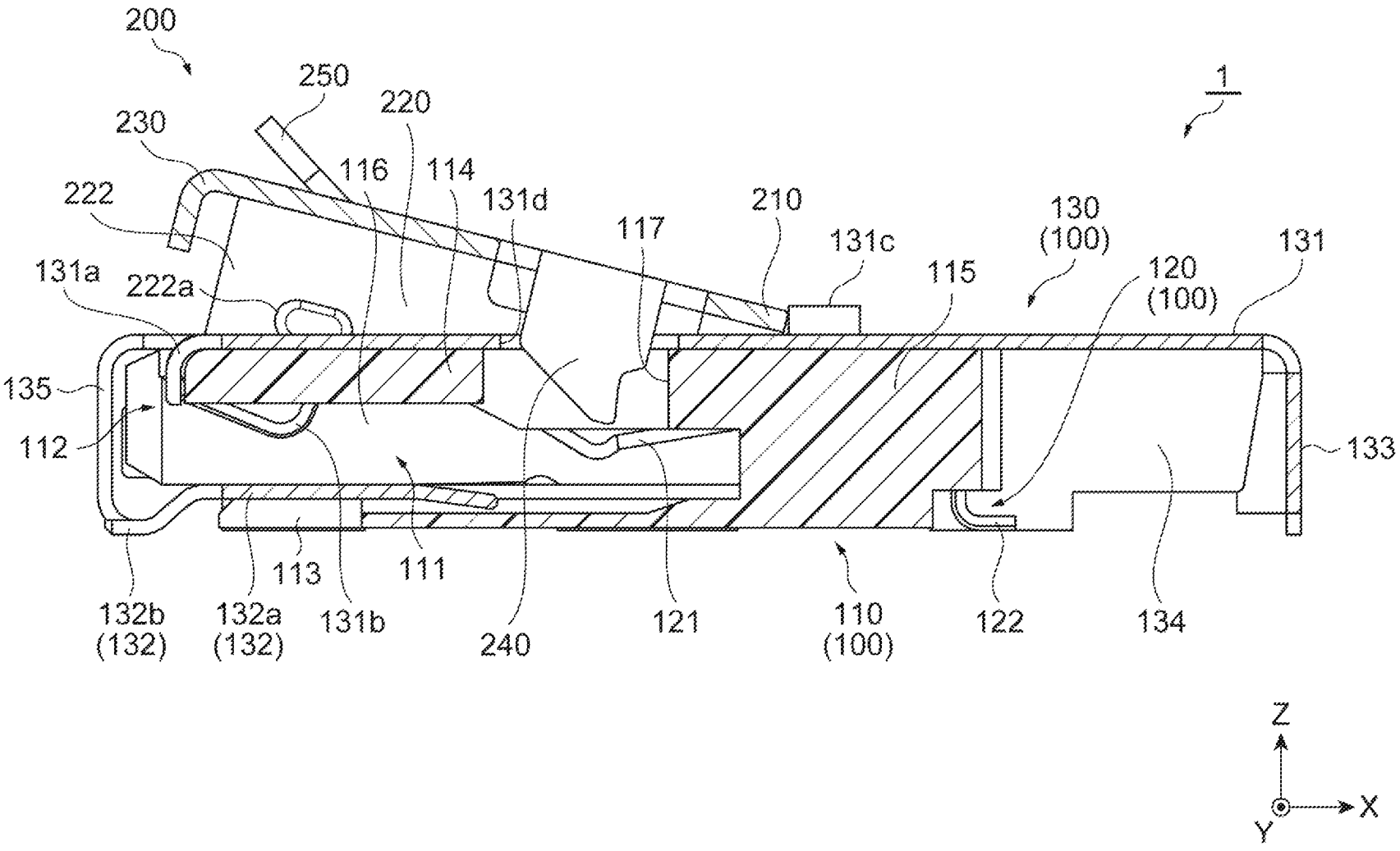
FIG. 13 is a cross-sectional view of the electrical connector of FIG. 12.

First, as shown in FIGS. 12 and 13, the operator grips the release operation portion 250 and then lifts the cover member 200 with respect to the main body 100. When the cover member 200 is lifted to a predetermined elevation angle, the base end portion 210*b* of the main plate 210 comes into contact with the protruding piece 131*c*, and rotation of the cover member 200 is hindered. In some examples, a rotation range of the cover member 200 is limited to a range of the predetermined elevation angle due to the presence of the protruding piece 131*c*. Additionally, a distal end of the restricting member 240 is retracted from the accommodation space 111 and is located in the through holes 117 and 131*d*.

Figure 14:
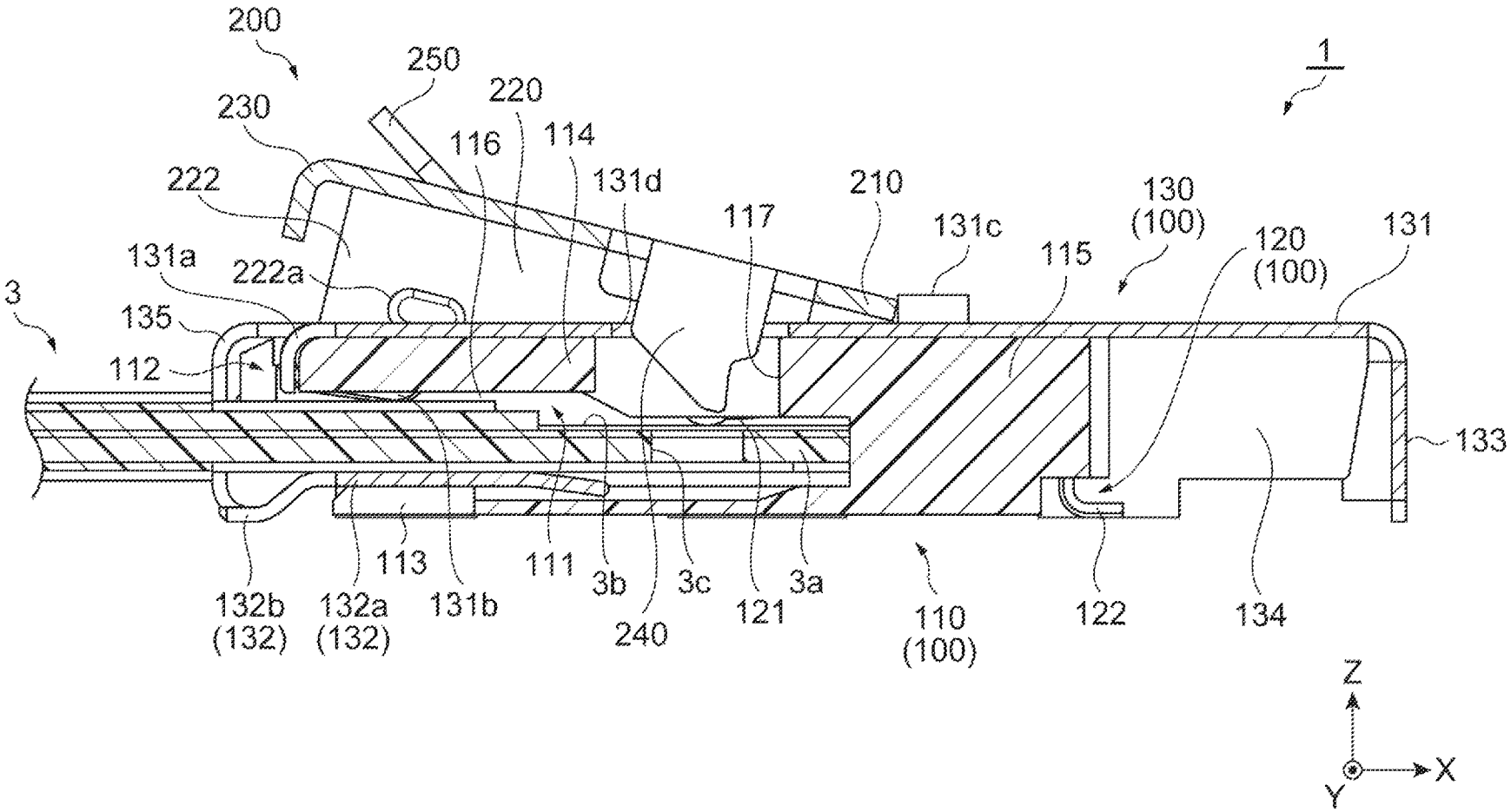
FIG. 14 is a cross-sectional view of the electrical connector configured to be connected to a signal transmission member.

Next, as shown in FIG. 14, the signal transmission medium 3 is inserted into the accommodation space 111 from the insertion opening 112. Thus, each of the plurality of signal lines 3*b* is physically and electrically connected to the corresponding contact 120. Further, the ground transmission path of the signal transmission medium 3 is physically and electrically connected to the ground terminals 131*b* or the main portion 132*a* of the bottom plate 132. Additionally, the cut-out portions 3*c* of the signal transmission medium 3 overlap the through holes 117 and 131*d* when seen in a height direction of the electrical connector 1 (the Z-axis direction).

Figure 15:
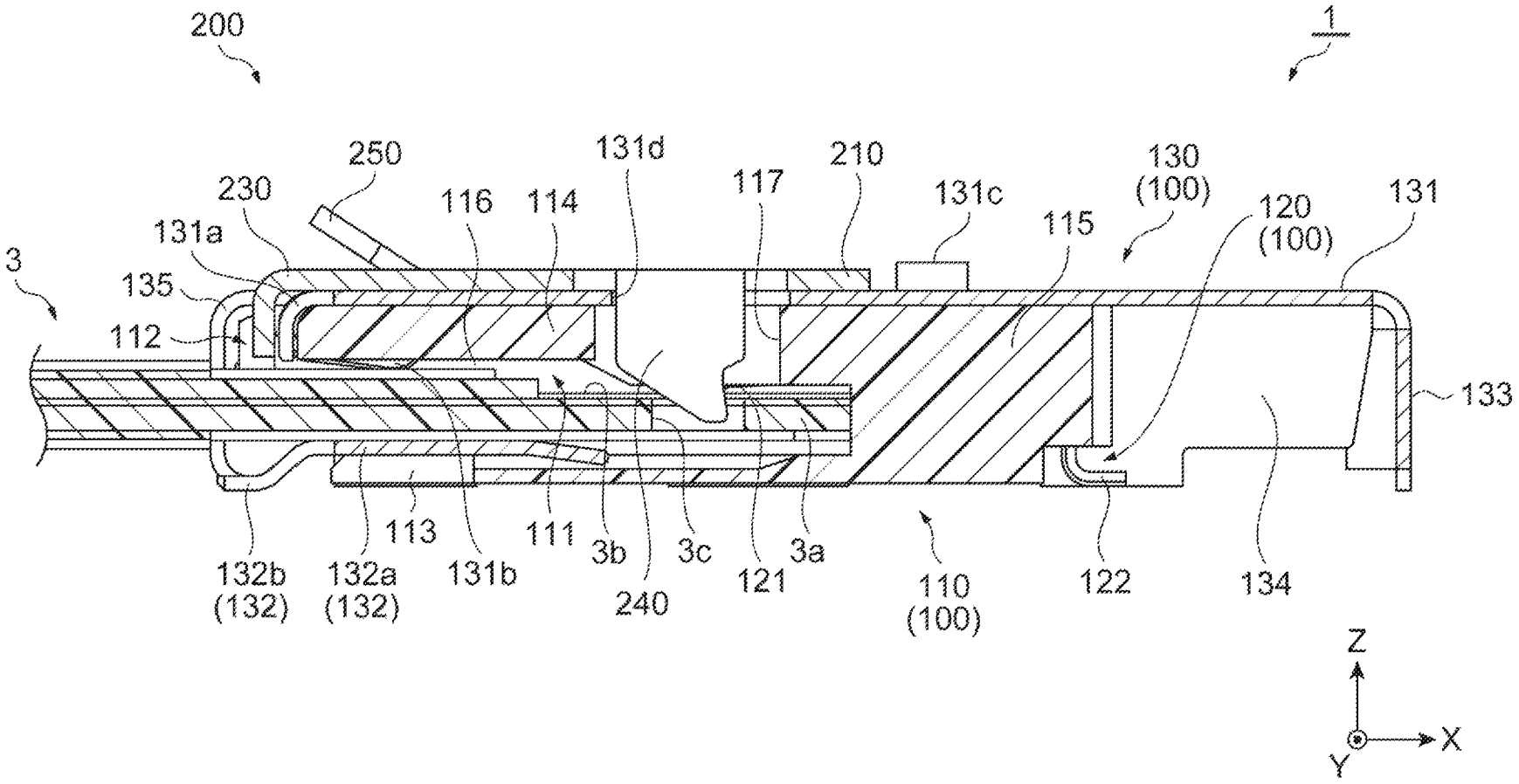
FIG. 15 is another cross-sectional view of the electrical connector configured to be connected to the signal transmission member.

Next, as shown in FIG. 15, the cover member 200 is brought close to the main body 100, and the cover member 200 overlaps the shell 130. Accordingly, the distal end of the restricting member 240 is located within the cut-out portion 3*c* of the signal transmission medium 3. Thus, the removal of the signal transmission medium 3 from the electrical connector 1 is restricted by the distal end of the restricting member 240.

When the cover member 200 approaches the main body 100 while the distal end portion 222 of the side plate 220 is slightly deformed (refer to FIGS. 11A and 11B), the protruding portion 222*a* enters the recess 134*a* and is locked in the recess 134*a*. Therefore, even when some external force acts on the cover member 200, the cover member 200 is maintained in a closed state to overlap the main body 100 due to the recess 134*a* and the protruding portion 222*a*.

The signal transmission medium 3 can be separated from the electrical connector 1 by performing a reverse procedure of the above.

Additional Operations

As shown in FIG. 3, even when the electrical connector 1 is installed in a narrow casing 4, a sufficient space for the signal transmission medium 3 to pass through is secured on the insertion opening 112 side. Therefore, although there is limited space on the rear wall portion 115 side of the housing 110, as described above, when the release operation portion 250 is located closer to the insertion opening 112 than the rotation shaft 134*f* in the state in which the cover member 200 overlaps the top plate 131 (when the cover member 200 is closed with respect to the main body 100), the operator can grip the release operation portion 250 located close to the insertion opening 112 and can operate the cover member 200.

In some examples, the rotation shaft 134*f* can be located at the center portion of the side plate 134 or located closer to the insertion opening 112 than the center portion of the side plate 134 in the depth direction of the main body 100 (the X-axis direction). Therefore, when the cover member 200 is opened and closed, the cover member 200 does not pass around the rear wall portion 115. Thus, even when the electrical connector 1 is installed in a narrow region, interference of the cover member 200 with other members (such as the casing 4) may be prevented.

In some examples, the rotation shaft 134*f* can be located at the center portion of the side plate 134 or located closer to the insertion opening 112 than the center portion of the side plate 134 in the depth direction of the main body 100 (the X-axis direction). Therefore, when the release operation portion 250 of the cover member 200 is lifted until the elevation angle of the cover member 200 reaches a predetermined size, the release operation portion 250 is lifted higher than in a configuration in which the rotation shaft 134*f* is located close to the rear wall portion 115. Thus, the connection target may be released or unlocked by the restricting member due to the relatively small operation of the cover member.

In some examples, the protruding piece 131*c* which serves as a stopper for limiting the rotation range of the cover member 200 is provided on the top plate 131 (the shell 130). Therefore, the rotation range of the cover member 200 may be limited to a predetermined range by the protruding piece 131*c*. Therefore, even when the electrical connector 1 is installed in a narrow region, a movable space for the cover member 200 is secured.

In some examples, when the elevation angle of the cover member 200 reaches a predetermined size, the cover member 200 comes into contact with the protruding piece 131*c*.

In some examples, the protruding piece 131*c* may be located at the center portion of the top plate 131 in the width direction of the top plate 131 (the Y-axis direction). Accordingly, even when the cover member 200 is opened very wide with respect to the main body 100, a load easily acts on the main body 100 via the protruding piece 131*c*. Thus, the load which can act on the rotation shaft 134*f* may be reduced.

In some examples, when it is assumed that the width of the top plate 131 is A, one protruding piece 131*c* can be located within a range of 0.2 A to 0.4 A, and the other protruding piece 131*c* can be located within a range of 0.6 A to 0.8 A in the width direction of the top plate 131 (the Y-axis direction). Accordingly, even when the cover member 200 is repeatedly operated over a period of time, stress may be readily dispersed to the cover member 200 and the main body 100. Therefore, the load which can act on the rotation shaft 134*f* may be further reduced.

In some examples, in the state in which the cover member 200 overlaps the top plate 131 (when the cover member 200 is closed with respect to the main body 100), the protruding portion 222*a* is locked in the recess 134*a*. Therefore, even when an unexpected external force acts on the cover member 200, inadvertent or unintended opening of the cover member 200 may be prevented.

In some examples, the top plate 131 of the shell 130 covers the entire top wall portion 114. Therefore, even when the signal transmission medium 3 inserted into the insertion opening 112 is displaced up and down (also referred to as "warping"), the warping of the signal transmission medium 3 is prevented by the presence of the shell 130. Thus, inadvertent or unintended lifting of the cover member 200 may be prevented.

In some examples, in the state in which the cover member 200 overlaps the top plate 131 (when the cover member 200 is closed with respect to the main body 100), the pair of bent portions 230 are respectively locked to the corresponding bent portions 131*a*, and the pair of restricting members 240 are respectively engaged with the corresponding through holes 117 and 131*d*. Therefore, in the closed state, when the cover member 200 moves relative to the main body 100 in a first direction from the bent portion 131*a* toward the through holes 117 and 131*d*, the bent portion 230 comes into contact with the bent portion 131*a*. Therefore, the movement of the cover member 200 in the first direction is restricted by the bent portion 131*a* and the bent portion 230. On the other hand, in the closed state, when the cover member 200 moves relative to the main body 100 in a second direction from the through holes 117 and 131*d* toward the bent portion 131*a*, the restricting member 240 comes into contact with the through holes 117 and 131*d*. Therefore, the movement of the cover member 200 in the second direction is restricted by the through holes 117 and 131*d* and the restricting member 240. Accordingly, the forward and backward movement of the cover member 200 may be restricted in order to prohibit or reduce contact between the shaft hole 221 and the rotation shaft 134*f*. Thus, the load acting on the rotation shaft 134*f* may be reduced while preventing rattling of the cover member 200.

In some examples, the rotation shaft 134*f* which is a part of the main body 100 (the shell 130) is engaged with the through hole 134*b* provided in the main body 100 (the shell 130). The distal end portion of the rotation shaft 134*f* may be held by itself such that even when an external force acts on the rotation shaft 134*f*, the distal end portion of the rotation shaft 134*f* is caught by the through hole 134*b*, and thus the rotation shaft 134*f* is less likely to be separated from the through hole 134*b*. Therefore, separation of the cover member 200 from the main body 100 may be prevented.

In some examples, the distal end portion of the rotation shaft 134*f* can pass through the through hole 134*b* to approach the housing 110. Therefore, even when a load acts on the rotation shaft 134*f* in a direction intersecting the rotation shaft 134*f* (the X-axis direction), the distal end portion of the rotation shaft 134*f* is securely caught by the through hole 134*b* in order to prevent the inadvertent separation of the rotation shaft 134*f* from the through hole 134*b*. Accordingly, the separation of the cover member 200 from the main body 100 may additionally be prevented.

In some examples, the auxiliary plate 134*d* and the bent portion 134*e* can serve as fixing portions which are fixed to the circuit board 2. The auxiliary plate 134*d* and the bent portion 134*e* may be fixed to another member, such as the circuit board 2, in order to prevent them from falling in a direction away from the side plate 134. Thus, even when an external force acts on the rotation shaft 134*f*, the distal end portion of the rotation shaft 134*f* may remain located in the through hole 134*b*. Accordingly, the separation of the cover member 200 from the main body 100 may be further prevented.

When the auxiliary plate 134*d* and the bent portion 134*e* are fixed to the circuit board 2, a gap generated between the shell 130 and the circuit board 2 may become smaller in order to further prevent leakage of electromagnetic waves to the outside of the electrical connector 1, and to prevent mixing of noise into the electrical signal transmitted by the contact 120.

In some examples, the inclined portion 134*g* of the rotation shaft 134*f* is inclined toward the bent portion 134*e*. Accordingly, when the cover member 200 is mounted on the main body 100, the cover member 200 is pushed toward the bent portion 134*e* when the portion of the cover member 200 in which the shaft hole 221 is formed is in contact with the inclined portion 134*g*, and thus the auxiliary plate 134*d* is naturally expanded by the portion in which the shaft hole 221 is formed. When the rotation shaft 134*f* overlaps the shaft hole 221, the rotation shaft 134*f* naturally enters the shaft hole 221 due to the spring property of the auxiliary plate 134*d* in order to facilitate attachment of the cover member 200 to the main body 100.

ADDITIONAL EXAMPLES

It is to be understood that not all aspects, advantages and features described herein may necessarily be achieved by, or included in, any one particular example. Indeed, having described and illustrated various examples herein, it should be apparent that other examples may be modified in arrangement and detail.

For example, at least one protruding piece 131*c* may be provided as a stopper on the top plate 131. The member which serves as the stopper may be provided on at least one of the cover member 200 and the main body 100. A member other than the protruding piece 131*c* may serve as a stopper. For example, the base end portion 210*b* of the main plate 210 of the cover member 200 may serve as a stopper.

In some examples, the state maintaining portion may be configured to maintain the closed state in which the cover member 200 overlaps the main body 100. Additionally, the closed state in which the cover member 200 overlaps the main body 100 may be maintained by the protruding portion provided on the distal end portion 222 and the recess provided in the side plate 134 which corresponds to the protruding portion.

Furthermore, the rotation shaft 134*f* may be engaged with an opening (for example, a recess, a groove portion, or the like) other than the through hole 134*b* provided in the side plate 134.

Still further, the rotation shaft 134*f* may be provided on the side plate 134, and an opening which is engaged with the rotation shaft 134*f* may be provided in the auxiliary plate 134*d*.

Additionally, the auxiliary plate 134*d* and the bent portion 134*e* may not be fixed to another member, such as a circuit board.

In some examples, the top plate 131 of the shell 130 may cover at least a portion of the top wall portion 114 in which the insertion opening 112 is formed.

By way of further example, the electrical connector 1 may not include the shell 130. Instead, a member corresponding to the member of the shell 130 (for example, the protruding piece 131*c*, the through hole 134*b*, the rotation shaft 134*f*, and so on) may be configured by the housing 110.

In additional examples, the rotation shaft 134*f* may be located closer to the rear plate 133 than the center portion of the side plate 134 in the depth direction of the main body 100 (the X-axis direction).

Figure 16:
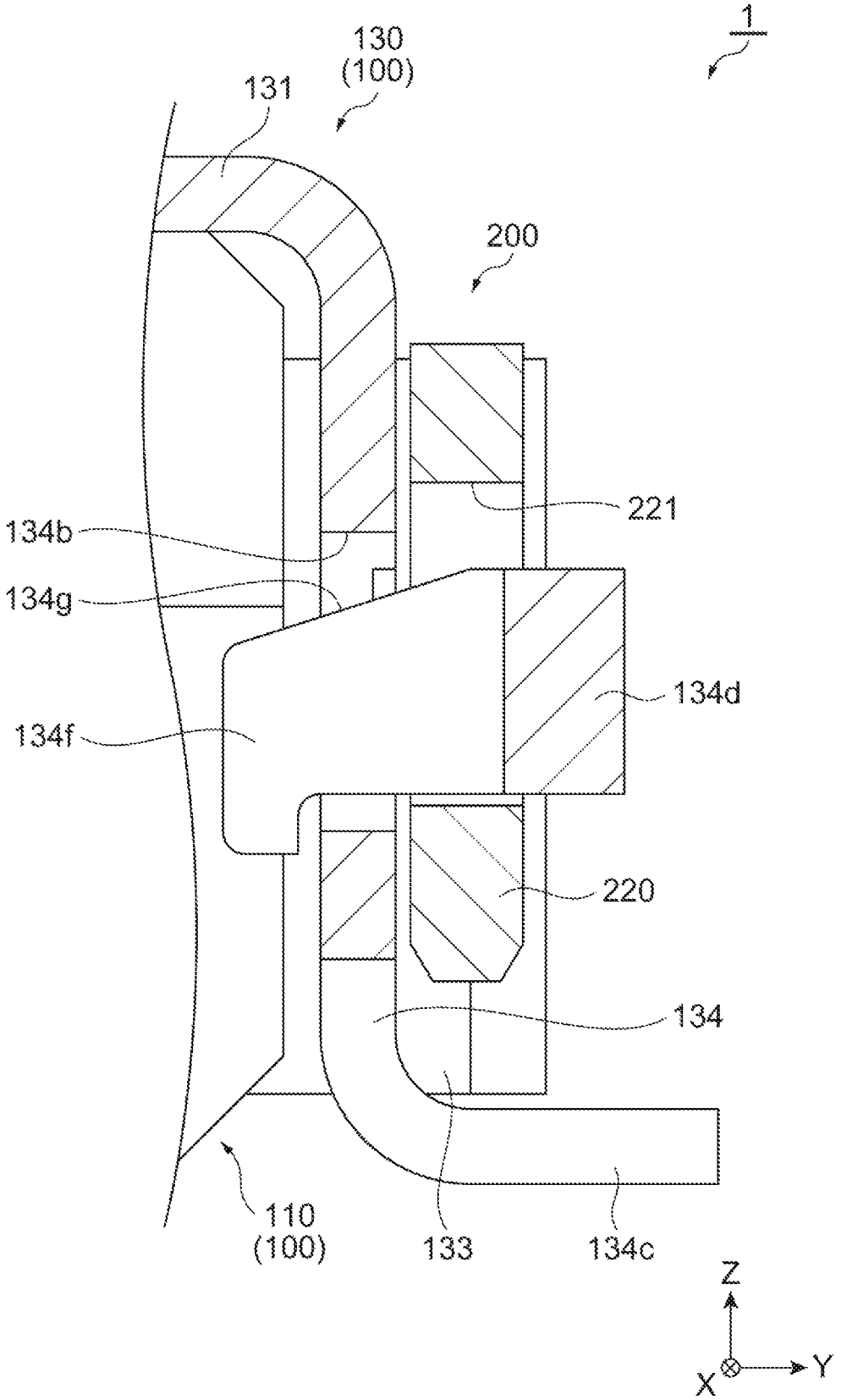
FIG. 16 is a cross-sectional view of another example electrical connector.

As shown in FIG. 16, the distal end portion of the rotation shaft 134*f* may have a hook shape. In some examples, when the cover member 200 is mounted on the main body 100, and the rotation shaft 134*f* is pushed into the through hole 134*b*, the distal end portion of the rotation shaft 134*f* is caught by the through hole 134*b*. Therefore, after completion of the electrical connector 1, even when an external force acts on the rotation shaft 134*f*, the rotation shaft 134*f* may remain fixed to the through hole 134*b* in order to prevent the separation of the cover member 200 from the main body 100.

What is claimed is:

1. An electrical connector comprising:

a main body comprising an insertion opening into which a connection target is inserted and an accommodation space to accommodate the connection target inserted into the insertion opening;

a conductive contact held in the main body so as to be connected to the connection target in the accommodation space; and a cover member rotatably mounted on the main body so as to be rotatable around a rotation axis passing through the main body, wherein the cover member includes:

a release operation portion configured to receive an external force to rotate the cover member around the rotation axis; and a restricting member configured to switch, in response to a rotation of the cover member, between a first state in which removal of the connection target from the accommodation space is restricted and a second state in which the connection target is released, wherein the insertion opening is spaced apart from, and opens away from, the rotation axis, wherein a distance between the release operation portion and the insertion opening is less than a distance between the rotation axis and the insertion opening, wherein the main body comprises a conductive shell, and wherein the cover member is conductive and overlaps the conductive shell in the first state, and is separated from the conductive shell in the second state.

2. The electrical connector according to claim 1, wherein the cover member further comprises a main plate which protrudes toward an opening direction of the insertion opening from a base end portion along the rotation axis, overlaps the conductive shell in the first state, and is separated from the conductive shell in the second state, and wherein the release operation portion is provided on a distal end of the main plate opposite to the base end portion.

3. The electrical connector according to claim 2, wherein the main body comprises a through hole, and wherein the restricting member is provided on the main plate and passes into the accommodation space via the through hole.

4. The electrical connector according to claim 3, wherein an end portion of the restricting member protrudes into the accommodation space in the first state.

5. The electrical connector according to claim 4, wherein the connection target comprises a recess, and wherein the end portion of the restricting member is located in the recess in the first state and is located out of the recess in the second state.

6. The electrical connector according to claim 2, wherein a distance between the release operation portion and the main body increases gradually toward the opening direction.

7. The electrical connector according to claim 2, further comprising a stopper portion configured to restrict a displacement of the main plate in the second state away from the main body.

8. The electrical connector according to claim 7, wherein the stopper portion is provided in the main body so as to come in contact with the base end portion in the second state.

9. The electrical connector according to claim 8, wherein a position where the stopper portion comes in contact with the base end portion and a width of the release operation portion overlap with each other in a direction along the rotation axis.

10. The electrical connector according to claim 9, wherein the stopper portion comprises a first protruding piece and a second protruding piece each protruding at different positions located along the rotation axis, and wherein a position where the first protruding piece comes in contact with the base end portion and a position where the second protruding piece comes in contact with the base end portion overlap with the width of the release operation portion along the rotation axis.

11. The electrical connector according to claim 10, wherein a center of the release operation portion is located between the first protruding piece and the second protruding piece along the rotation axis.

12. The electrical connector according to claim 7, wherein the base end portion is located between the rotation axis and the insertion opening in the first state.

13. The electrical connector according to claim 2, further comprising a plurality of conductive contacts including the contact, wherein the plurality of contacts are held by the main body so as to be arranged along the rotation axis, wherein the connection target comprises a plurality of signal transmission members arranged along the rotation axis in the accommodation space, and wherein each of the plurality of contacts are respectively connected to one of the plurality of signal transmission members in the accommodation space.

14. The electrical connector according to claim 13, wherein the insertion opening extends in a slit shape along the rotation axis.

15. The electrical connector according to claim 13, wherein the cover member includes two restricting members including the restricting member, wherein each of the two restricting member restricts a removal of the connection target from the accommodation space in the first state and releases the connection target in the second state, and wherein the plurality of contacts are sandwiched between the two restricting members along the rotation axis.

16. The electrical connector according to claim 2, wherein the main body comprises a first engaging portion, the cover member comprises a second engaging portion which engages with the first engaging portion in the first state, and wherein the second engaging portion, while engaged with the first engaging portion, opposes a positional displacement of the main plate from the first state to the second state.

17. The electrical connector according to claim 16, wherein the main body comprises a side face intersecting the rotation axis, the cover member comprises a side plate overlapping the side face, the first engaging portion is provided in the side face, and the second engaging portion is provided in the side plate.

18. The electrical connector according to claim 2, wherein the main body comprises an insulating housing comprising the insertion opening and the accommodation space and the conductive shell covers the housing, and wherein the shell comprises a bent portion which covers, in an outer surface of the housing, at least part of an end face of the housing where the insertion opening is located.

19. The electrical connector according to claim 18, wherein the shell further comprises a ground terminal provided at the bent portion so as to be connected with the connection target in the accommodation space.

20. The electrical connector according to claim 1, wherein the main body includes a back face which faces away from the opening direction of the insertion opening, and wherein a distance between the rotation axis and the insertion opening is less than or equal to a distance between the rotation axis and the back face.

21. An electrical connector comprising:

a main body comprising an insertion opening into which a connection target is inserted and an accommodation space to accommodate the connection target inserted into the insertion opening;

a conductive contact held in the main body so as to be connected to the connection target in the accommodation space; and a cover member rotatably mounted on the main body so as to be rotatable around a rotation axis passing through the main body, wherein the cover member includes:

a release operation portion configured to receive an external force to rotate the cover member around the rotation axis; and a restricting member configured to switch, in response to a rotation of the cover member, between a first state in which removal of the connection target from the accommodation space is restricted and a second state in which the connection target is released, wherein the insertion opening is spaced apart from, and opens away from, the rotation axis, wherein a distance between the release operation portion and the insertion opening is less than a distance between the rotation axis and the insertion opening, wherein the main body comprises a first protruding piece and a second protruding piece each protruding at different positions located along the rotation axis so as to come in contact with the cover member in the second state, and wherein a position where the first protruding piece comes in contact with the cover member and a position where the second protruding piece comes in contact with the cover member overlap with a width of the release operation portion along the rotation axis.

* * * * *